US005255966A

United States Patent [19]

Newhouse et al.

[11] Patent Number: 5,255,966

[45] Date of Patent: Oct. 26, 1993

[54] FREESTANDING FURNITURE ENSEMBLE

[75] Inventors: Thomas J. Newhouse, Grand Rapids; Donald A. Shepherd, Spring Lake, both of Mich.

[73] Assignee: Herman Miller, Inc., Zeeland, Mich.

[21] Appl. No.: 653,033

[22] Filed: Feb. 8, 1991

[51] Int. Cl.[5] ..... A47B 87/00

[52] U.S. Cl. ..... 312/107; 312/195; 108/64

[58] Field of Search ..... 312/195, 198, 203, 107, 312/108; 108/64

[56] References Cited

U.S. PATENT DOCUMENTS

| | | | |
|---|---|---|---|
| D. 102,035 | 11/1936 | Meyerhoff . | |
| D. 110,534 | 7/1938 | Hickerson . | |
| D. 110,696 | 8/1938 | Hanson . | |
| D. 115,145 | 6/1939 | Dillon . | |
| D. 151,111 | 9/1948 | Westlake . | |
| D. 156,561 | 12/1949 | Rice . | |
| D. 159,488 | 8/1950 | Jiranek . | |
| D. 160,103 | 9/1950 | Manning . | |
| D. 175,790 | 10/1955 | McCann . | |
| D. 176,412 | 12/1955 | Herrmann . | |
| D. 188,447 | 7/1960 | Kegel et al. . | |
| D. 188,727 | 8/1960 | Lubberts et al. . | |
| D. 189,040 | 10/1960 | Knudsen . | |
| D. 189,041 | 10/1960 | Knudsen . | |
| D. 190,652 | 6/1961 | Borden . | |
| D. 190,653 | 6/1961 | Borden . | |
| D. 190,654 | 6/1961 | Borden . | |
| D. 190,655 | 6/1961 | Borden . | |
| D. 210,134 | 2/1968 | Christensen et al. . | |
| D. 214,502 | 6/1969 | Jones . | |
| D. 223,838 | 6/1972 | Valie . | |
| D. 230,198 | 1/1975 | Laughon . | |
| D. 237,928 | 12/1975 | Kent . | |
| D. 238,841 | 12/1976 | Goulooze . | |
| D. 241,395 | 9/1976 | Perl et al. . | |
| D. 249,861 | 10/1978 | Adkinson . | |
| D. 251,279 | 3/1979 | Winig . | |
| D. 251,526 | 4/1979 | Zapf . | |
| D. 255,188 | 6/1980 | Zapf . | |
| D. 267,917 | 2/1983 | Faldmo et al. . | |
| D. 296,057 | 6/1988 | Rosen . | |
| D. 312,927 | 12/1990 | Martin et al. . | |
| 1,700,203 | 1/1929 | Baker . | |
| 1,929,063 | 10/1933 | Hampton . | |
| 2,665,963 | 1/1954 | Wallack . | |
| 2,783,107 | 2/1957 | Gacht . | |
| 3,053,598 | 9/1962 | Cheslow . | |
| 3,367,291 | 2/1968 | Evans . | |
| 3,368,856 | 2/1968 | Tisdale | 312/111 |
| 3,644,008 | 2/1972 | Overby | 312/111 |
| 3,713,717 | 1/1973 | Hafner . | |
| 3,964,401 | 6/1976 | Gutmann, Jr. et al. . | |
| 4,313,149 | 1/1982 | Hirose et al. . | |
| 4,363,587 | 12/1982 | Rooklyn . | |
| 4,368,804 | 1/1983 | Cole . | |
| 4,570,156 | 2/1986 | Nicholas, Jr. . | |
| 4,960,307 | 10/1990 | Nelsen . | |

OTHER PUBLICATIONS

Herman Miller, Inc., "C-Forms--Design solutions for private offices and open plan spaces," Brochure of Herman Miller, Inc., Office/Institution Division, ©1980.

Herman Miller, Inc., "C-Forms," Brochure of Herman Miller, Inc., Office/Institution Division, ©1980.

Herman Miller, Inc., "Wardrobe, Storage, and Filing Cabinets," Brochure of Herman Miller, Inc., Office/Institution Division, ©1981.

*Primary Examiner*—Kenneth J. Dorner

*Assistant Examiner*—Gerald A. Anderson

*Attorney, Agent, or Firm*—Varnum, Riddering, Schmidt & Howlett

[57] ABSTRACT

Office furniture includes a number of individual furniture components all incorporating the same basic constructional details and ornamentation and which articles of furniture may be selectively associated with one another to form selective furniture ensembles which can provide a complete work area. One feature of the invention is to provide a furniture top which has notched edges which selectively receive a corresponding end of another article of furniture so as to interlock several articles of furniture into a furniture ensemble in a manner to resist relative movement. In addition, certain edges of furniture tops are notched and have a straight vertical edge to indicate a functional component such as a pull-out pedestal drawer or a cabinet area with edges of the tops being arcuately convexly downwardly curved for user interface. The individual components include desks, credenzas, organizers, returns and storage columns. The components are designed to be adaptable for numerically controlled machinery manufacture for individual selectivity and efficient manufacture.

14 Claims, 16 Drawing Sheets

FREESTANDING FURNITURE ENSEMBLE

BACKGROUND OF INVENTION

1. Field of the Invention

This invention relates in general to new and useful improvements in complete ensembles of office furniture wherein several pieces of furniture are assembled as a unit to accomplish the functions of meetings, technology and storage, and more specifically to office furniture wherein two or more pieces of freestanding furniture are arranged together in interfitting arrangements. In one of its aspects, the invention relates to an ensemble of case goods furniture comprising interfitting and interrelated component desks, organizers, and storage columns. In another of its aspects, the invention relates to an office furniture assemblage having two or more components which have rounded user interface edges which are joined together through a notch to form a uniform flush jointed corner. In yet another of its aspects, the invention relates to a furniture ensemble combining a work surface component and storage column. In another of its aspects, the invention relates to case goods furniture which is both functional and attractive, yet which lends itself through design to computer controlled machine manufacture. In still another of its aspects, the invention relates to a desk or credenza wherein the front edge surface of the top integrates design and user functions.

2. State of the Prior Art

It is well known to provide an office furniture ensemble wherein two or more pieces of furniture are arranged in cooperating relation. A typical arrangement is the combination of a desk, credenza and a table arranged in a U-shaped pattern. At the present, such pieces of office furniture are separate and independent of one another and are merely positioned in close abutting relation with the pieces of furniture being separate relative to each other. Typically, the edges of the components are flat and abut one another in connected or unconnected relationship.

In the past, traditional case goods office furniture has been designed for aesthetics for traditional functions of writing, conferencing, drawer storage and, occasionally, with the use of dictation equipment. Desk tops overlie drawers and separate credenzas are provided. Occasionally, returns have been provided for the desks. The desks function as writing surfaces and occasionally as conference surfaces, and the credenza functions as storage. The desks and credenzas are interrelated principally due to finishes and aesthetic design of hardware and perhaps details of the cabinets. However, most of the office furniture is not especially functional for work environments which integrate with machines such as computers as systems furniture does. Machines, such as CPUs, printers, terminals and wiring for such equipment, are typically positioned on or near the work surfaces, adding to clutter and diminishing productivity. Further, in present office furniture, there are very few available work enhancing options, most of which are not particularly adaptable to the habits of the worker. Case goods have been designed for aesthetics, not function.

Heretofore, Herman Miller, Inc. introduced a line of case goods furniture which included desks, credenzas, cabinets, work organizers and mobile files. The desks were typically arranged perpendicular to the work organizer. A return was available with the desk. The cabinets were wardrobe, storage and filing cabinets. The desks, credenzas and organizers had rounded front and back edges and vertical side edges of slightly different construction. This line of furniture, called C-Forms, had many of the inflexibility problems of case goods and did not effectively deal with the machine integration problems.

Systems furniture, on the other hand, gives the user a rich mixture of work oriented furniture, finishes and decorative arrangements. Examples of system furniture are Herman Miller's ETHOSPACE® environment system furniture and ACTION OFFICE® system furniture. The system furniture, although very functional, does not conform with some traditional notions of office furniture used principally in enclosed offices.

SUMMARY OF THE INVENTION

This invention brings to traditional quality office furniture a rich mix of functional options for personalizing a work station to meet a worker's work habits, aesthetic and status needs. The invention recognizes the asymmetry of the office and the asymmetry of the office worker and provides a product to complement these features in compositionally balanced office furniture. There is a delicate balance between the function and the richness of choices to provide highly functional office furniture which conforms to traditional notions of case goods furniture. Office furniture in accordance with this invention meets user work needs and the changing needs of technology in traditional types of furniture, yet with cost-effective manufacturing techniques. There is a high degree of resolution in the products. One of the main focuses of the office furniture in accordance with this invention is the computer-driven technology office. Another focus is the paper intensive office.

Office furniture in accordance with this invention is directed to three main office functions: meetings, technology usage and storage. These three functions are integrated within an assemblage of office furniture. They are orchestrated around a work center.

According to the invention, there is provided an ensemble of office furniture components having first and second work surface panels of separate components at work surface height above the floor, each of the work surface panels having front edges and end edges bounding three sides of the work surface and portions of the front edges of rounded configuration. The work surface panels are positioned in perpendicular relationship to each other with a first end edge of one work surface panel abutting a front edge of a second work surface panel The front edge of the second work surface panel has a notch or offset portion in confronting relationship with the end edge of the first work surface panel. The notch has a concavely curved surface portion at one end thereof joining the notch with the rounded front edge portion of the second work surface panel. The surface of the notch and the end edge of the first work surface have complementary surfaces in abutting relationship with each other so that the first and second work surfaces have rounded front edges converging in a flush jointed corner. Typically, the notch or offset portion extends to a first end edge of the second work surface so that the first and second work surfaces form an L-shape. The notch or offset portion and the first end edge of the first work surface are substantially vertical in orientation, normal to the first and second work surface panels. The radius of curvatures of the front edge portion of the first and second work surface panels are substantially equal and the notch has a depth substantially equal to the radius of curvature of the front edge portions.

In one embodiment, the first work surface front edge has a notch or offsetting portion at an end portion distal from the first end edge. A drawer pedestal is mounted to and beneath the first work surface panel and in register with the first work surface notch. The drawer pedestal has drawers with front surfaces coplanar with the first work surface panel notch.

In another embodiment, the second work surface panel has a second notch or offset portion in the front edge at an end thereof distal from the first end edge, with the two notches preferably being mirror images of each other. In this embodiment, a drawer pedestal is mounted to and beneath the second work surface panel and in register with the second notch. The drawer pedestal preferably has drawers with front surfaces coplanar with the second notch. The drawers have at an inside edge of the front surfaces thereof a forwardly projecting vertical strip which in cross section generally follows the contour of the front edge of the overlying work surface panel, thereby forming a handle for the drawers.

Further, according to one embodiment of the invention, the second work surface panel has a forwardly directed portion of the front edge forming a diagonal corner adjacent the first end edge for supporting a keyboard. In like manner, a forwardly directed portion of the front edge can form a diagonal corner adjacent the opposite end edge for supporting a keyboard as well.

Further according to the invention, there is provided a furniture ensemble comprising first and second articles of office furniture abutted together in end-to-edge relation, the first article of furniture comprising a flat panel member having the edge, the edge having therein starting at one end thereof an elongated notch, the notch opening at one end of the notch through the one end and an opposite end of the notch being defined by a concavely curved edge portion, the notch also including an edge extending between the one end and the curved edge. The second article of furniture has an end edge seated in the notch. In this manner, furniture components are interrelated through the notch arrangement to define interfitting furniture components.

With this arrangement, desks and organizer can be assembled together. In addition, organizers and credenzas can be assembled together In like manner, desks, credenzas and returns or bridges can be assembled together to define complex, asymmetrical work areas.

Further according to the invention, there is provided a desk or credenza comprising a flat work surface panel supported by at least one pedestal, the work surface panel having front and rear edges and end edges with the front edge having an offset portion adjacent one of the end edges in alignment with the pedestal. The offset can be inwardly or outwardly of the other portions of the front edge. Preferably, the front edge is rounded adjacent the offset portion to define a user interface of the work surface panel and the offset portion is normal to the work surface panel to define a component edge. Further, the pedestal comprises a drawer unit having at least one drawer with a front provided with a contoured edge forming a handle. The drawer front is formed of woodlike material and the handle is generally U-shaped in cross section, including one leg recessed in a door. The handle is vertical in orientation and in cross section generally follows the contour of the overlying front edge of the work surface panel.

In one embodiment, there are two remote drawer panels, one beneath each end portion of the work surface panel and there is another offset portion in the work surface panel front edge above and in register with each pedestal. The front edge of the desk or credenza is rounded between the offset portions to define a user interface, the offset portions are coextensive with the pedestals and generally vertical, normal to the work surface panel, to define a component interface. Preferably, the drawers of the pedestal have front surfaces which are substantially coplanar with the offset portions.

In one embodiment, the pedestals are separated by a storage area. Doors are mounted to the pedestals to enclose the storage area and form a credenza.

In yet another embodiment, one or more storage columns are seated on the work surface overlying the pedestal or pedestals. Each of the storage columns comprises a cabinet defining an open front and a door pivotably mounted to the cabinet. In another embodiment, there are two storage columns mounted on the work surface and organizer shelves extend between the storage columns.

Still further according to the invention, there is provided a furniture ensemble comprising a freestanding cabinet having a base, sidewalls, back wall and top wall, all joined together to form an open front cabinet, and a door pivotably mounted to a sidewall of the cabinet and covering the open front thereof. An organizer unit is in abutting relationship to the cabinet and comprises a back wall, at least one sidewall, and a work surface at a working height above the floor. Organizer shelves are mounted to at least one of the sidewalls and back wall above the work surface in overlying relationship to the work surface. The organizer has a plurality of open file-receiving openings for paper and file organization. The user of this ensemble can use the cabinet and work surface and the organizer unit in cooperative arrangement with each other.

In an electronic-intensive use of this ensemble, the organizer can be connected to the freestanding cabinet and a grommet can provide passage in the sidewall of the cabinet to pass wiring from the cabinet to the organizer. The grommet is preferably in a lower part of the cabinet sidewall to pass wiring from the lower part of the cabinet to a lower part of the organizer beneath the work surface. Further, the work surface preferably has a grommet therein to form a passage for wiring through the work surface panel. The organizer/cabinet is preferably combined with a desk unit having a second work surface in abutting relationship with the organizer work surface. In a preferable embodiment, the organizer work surface has a notch in a front edge at one end of the panel remote from the cabinet and an end of the second work surface panel is received within the notch in the organizer work surface panel.

In this ensemble according to the invention, the organizer can be connected to a return through a notched arrangement described above and a desk can be positioned at an end of the return, thereby forming a U-shaped work area which includes the desk, the return or bridge, the organizer and the cabinet.

In a further embodiment of the invention, the cabinet has at least one removable floor panel on the base and has an opening for passage of wiring from the base into the cabinet interior.

In yet another embodiment of the invention, a furniture column comprises a base, a storage cabinet seated on the base and enclosed by a door, an adjacent shelf unit is seated on the base and has an open front in an overlying flat panel covering the storage cabinet and the shelf unit. The flat panel preferably has a front edge notched in alignment with the storage area and the front edge is convexly rounded in alignment with the shelf unit. The door preferably has an ornamental forwardly projecting edge adjacent the shelf unit, the projecting edge forming a handle for the door and having a cross-sectional configuration which generally follows the configuration of the front edge of the overlying flat panel. The shelf unit preferably projects forwardly of the storage area in accordance with the projections of the handle and the base projects forwardly in alignment with the shelf in a like manner.

Still further according to the invention, there is provided a stand-up desk comprising a pedestal and a storage column in spaced relation, a flat desk-forming panel overlying the pedestal and having an end secured to the column in supported relation. The storage column has a height greater than the pedestal. Preferably, the panel has front and rear edges and the front edge is notched in alignment with the pedestal. The front edge between the notch and column is downwardly and forwardly convexly rounded to define a user interface. Preferably, a shelf extends between the pedestal and the column in underlying relationship to the panel. Further, a footrest is preferably provided between the pedestal and the column in underlying relationship to the panel.

In this embodiment, the pedestal preferably is a drawer unit having at least one drawer with a drawer front having a forwardly extending vertical strip which in cross section generally follows the contour of the front edge of the overlying panel, thereby forming a handle. The column preferably is a cabinet having a base, sidewalls, back wall and top panel joined together to form an open-front enclosure and a door is pivotably mounted to one of the sidewalls to close the open front of the cabinet. The door is preferably pivotably mounted to the sidewall remote from the pedestal so that the door opens away from the pedestal for easy access to the column by a worker using the stand-up desk.

Still further according to the invention, there is provided an article of furniture in the form of an upstanding storage unit formed by a base, a pair of opposite sidewalls, a back wall and a top overlying panel joined together. A front closure panel encloses an open front of the unit. The front closure panel has at one side thereof a forwardly projecting vertical strip defining a handle. The overlying top panel further has a front projection aligned with the vertical strip and of like configuration.

In one embodiment, the article of furniture is a pedestal which includes at least one drawer and the front closure panel is at least one drawer front which is coplanar with a front edge of the overlying top panel.

In another embodiment, the article is a storage cabinet and the closure panel is a door which is pivotably mounted to one of the sidewalls. The door has a front surface which is coplanar with a front edge of the overlying top panel.

Still further according to the invention, there is provided a furniture ensemble for a work area comprising a desk having a first work surface at a working height above the floor, an organizer having a second work surface contiguous with the desk work surface, sidewalls and a back wall. A cabinet is provided in the organizer above the work surface and laterally coextensive therewith. A column in the form of a cabinet has a door which opens into the work area.

Preferably, the first and second work surfaces have an interface through formed edges to define a compact work area. The organizer second work surface and the cabinet are preferably mounted to the other sidewall of the column.

The invention provides a rich mix of components which can be selected by a user. The components can be manufactured by numerically controlled machinery to produce the work area to the specification of the user without any additional cost. The components of the ensembles are highly functional and adaptable to machine oriented or paper oriented environments, yet have a traditional case good appearance.

BRIEF DESCRIPTION OF THE DRAWINGS

With the above and other objects in view that will hereinafter appear, the nature of the invention will be more clearly understood by reference to the following detailed description, the appended claims, and the several views illustrated in the accompanying drawings.

GENERAL DESCRIPTION OF THE INVENTION

Figure 1:
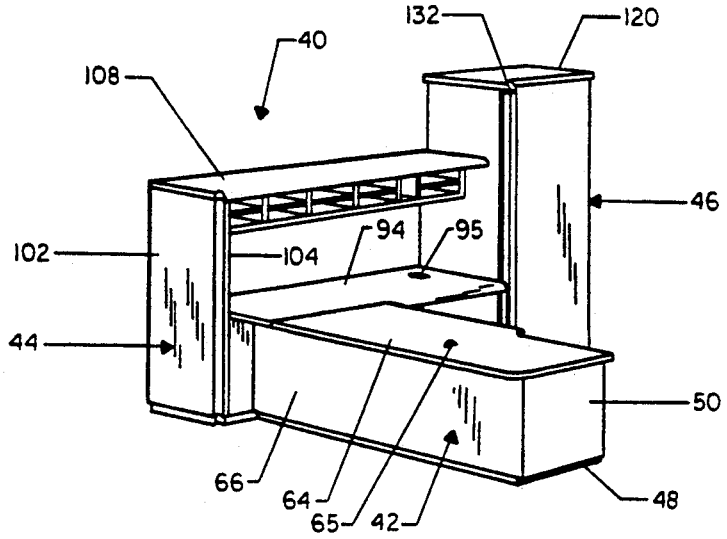
FIG. 1 is a perspective view of a furniture ensemble according to the invention.

Referring now to the drawings in detail, reference is first made to FIGS. 1 through 10 wherein there is illustrated the details of a furniture ensemble generally identified by the numeral 40. The furniture ensemble 40 is formed of three separate pieces of furniture including a desk 42, an organizer 44 and a storage column 46. The desk 42 is disposed in a right angular relation with respect to the organizer 44 and the storage column 46 is disposed at one end of the organizer 44 remote from the desk 42.

Figure 4:
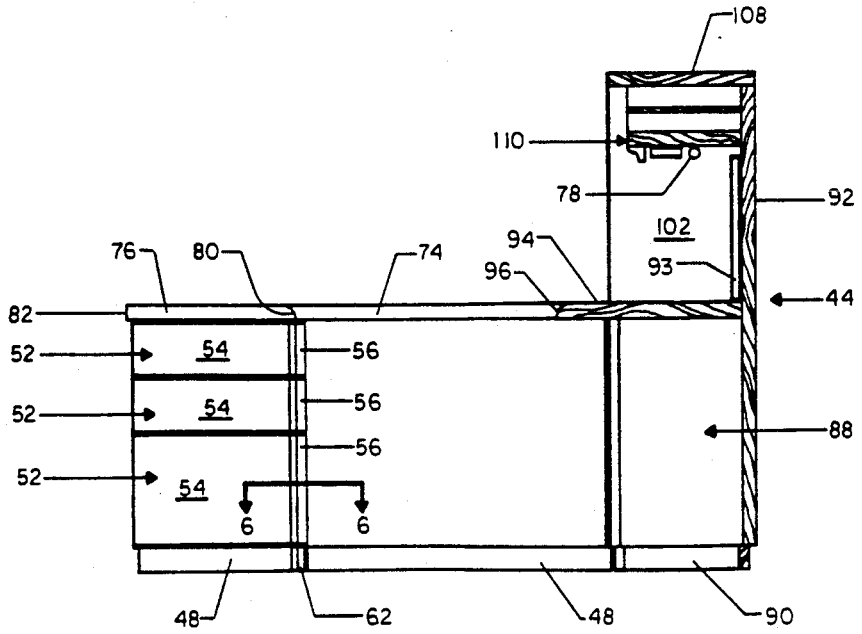
FIG. 4 is a vertical sectional view taken generally along the line 4—4 of FIG. 2 and shows still further details of the furniture ensemble.
Figure 6:
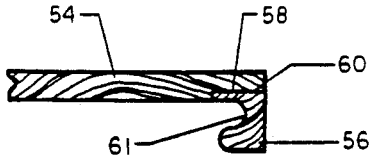
FIG. 6 an enlarged fragmentary horizontal sectional view taken generally along the line 4—4 of FIG. 4 and shows the details of a drawer front and an associated handle.
Figure 7:
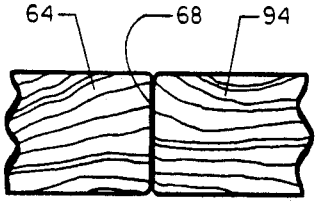
FIG. 7 is an enlarged fragmentary vertical sectional view taken generally along the line 7—7 of FIG. 2 and shows the relationships of abutting surfaces.

The desk 42 is formed of a base 48 having seated on the left end thereof a pedestal 50 which, as is best illustrated in FIG. 4 is a multiple drawer pedestal. Each drawer 52 includes a drawer front 54 which, as is best illustrated in FIG. 6, is provided at one side thereof with a projecting vertically extending ornamental strip 56 which functions as a handle. The handle 56 is generally U-shaped in horizontal cross section and includes a thin leg 58 which is seated in a machined recess 60 in the right edge of the drawer front 54. The handle 56 thus forms an elongated recess 61 at one side of the drawer front 54 for gripping by a desk user to open the drawer.

As best shown in FIG. 4, the base 48 is also provided with a vertically extending ornamental strip 62 which is vertically aligned with the handles 56.

Figure 3:
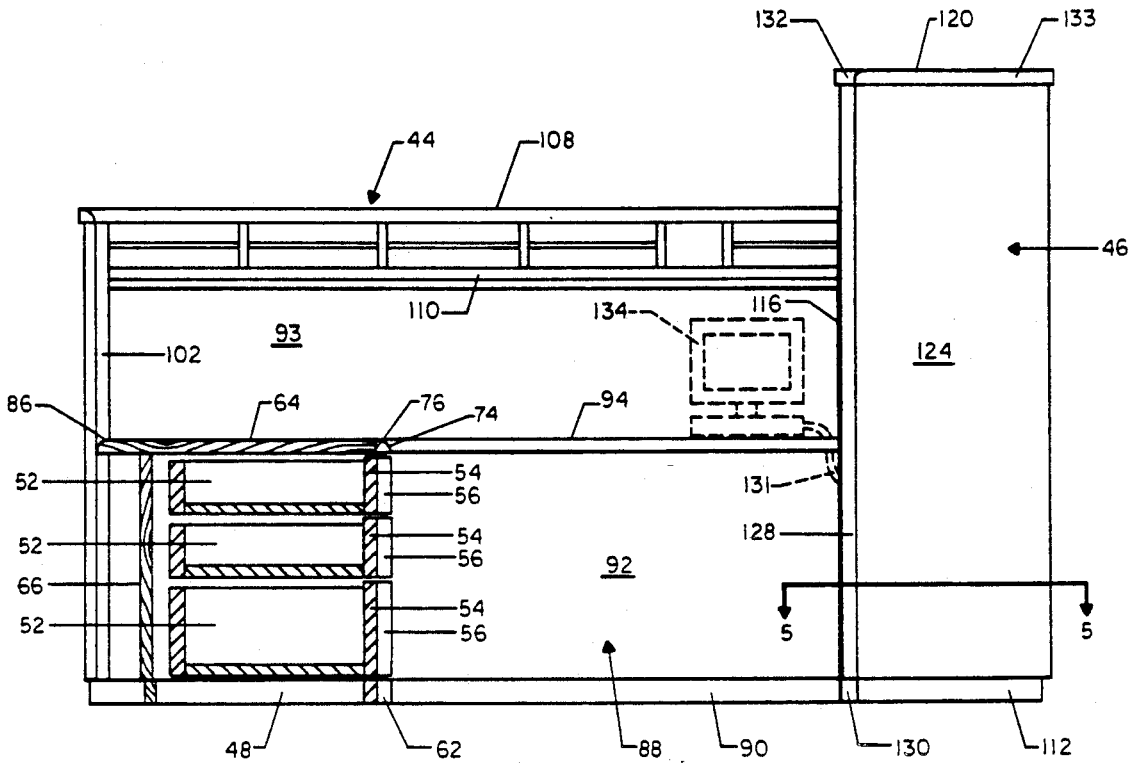
FIG. 3 is an enlarged vertical sectional view taken generally along the line 3—3 of FIG. 2 and shows further details of the furniture ensemble.

The desk 42 also includes a top panel 64 in the form of a desk top and a front modesty skirt 66. The desk top 64 has a vertical right end 68 which terminates in a rounded front corner 70. The desk top 64 also includes a user portion 72 which terminates in a downwardly and forwardly convexly curving edge 74. The front curving edge 74 blends with the rounded corner 80 to make a top edge which curves convexly toward the edge 74 and downwardly at the same time. The front edge of the desk top 64 is also provided adjacent the edge portion 74 with a notch 76 which is aligned with the pedestal 50. The notch 76, as shown in FIG. 3 includes a vertical edge and terminates in a concavely rounded corner 80 which is aligned with the handle 56. A grommet 65 is provided in the desk top 64 to provide a passage for communication wiring for a telephone, for example.

The desk top 64 has a second square cut end 82 which terminates in a front rounded corner 84. Further, the desk top 64 has a forwardly and downwardly convexly curved back edge 86 which invites one to utilize the front edge of the desk top 64 as a work or conference surface. The convexly curving edges 74 and 86 invited user interface, i.e., one feels comfortable seated before the convexly curved edges 74 and 86. Thus, the desk user typically works at the curved edge 74 and the desk user typically conferences or meets with one seated at the curved edge 86.

Figure 2:
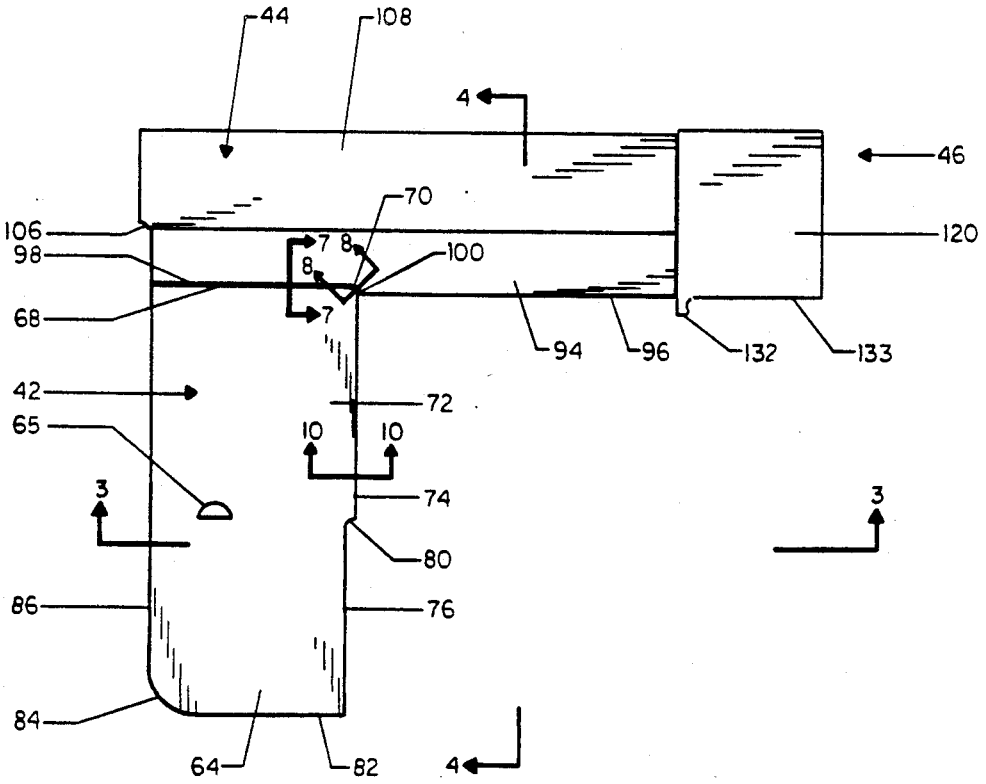
FIG. 2 is a plan view of the ensemble shown in FIG. 1.
Figure 8:
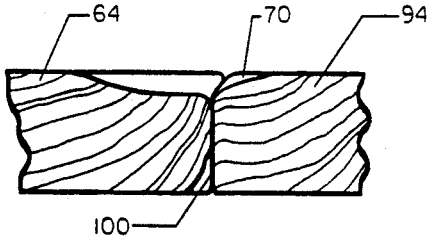
FIG. 8 is an enlarged fragmentary vertical sectional view taken generally along the line 8—8 of FIG. 2 and shows the relationship of other abutting surfaces.

Reference is now made to the details of the organizer 44 which, as shown in FIG. 4, includes a lower storage space 88 which overlies a base 90 which is similar to the desk base 48. The organizer 44 includes an upstanding rear wall 92 and overlying the storage space 88 is a panel 94 which is provided with a downwardly and outwardly convexly rounded edge 96 which invites the use of the panel 94 as a work area. A tackboard 93 is mounted to a front of the rear wall 92. As is best shown in FIG. 2, the panel 94 adjacent the edge 96 is provided with a notch 98. The notch 98 is a configuration similar to the notch 76 and matches the configuration of the end 68 of the desk 42. While the desk 42 is separately formed from the organizer 44, as is clearly shown in FIGS. 7 and 8, the vertical surfaces abut one another and serve to generally interlock the desk top 64 with the panel 94. It will also be seen that the notch 98, adjacent the edge 96 is provided with an internally rounded corner 100 which matches the corner 70 of the desk top 64. Both corners 70 and 100 form complex shapes which smoothly change from a vertical edge surface to a convexly rounded edge surface. The transformation takes place smoothly and congruently on each edge so that the top surfaces of desk top 64 and the panel 94 form a neat smooth corner as seen in FIG. 8. A grommet 95 is provided near the rear wall 92 and near the storage column 46 to provide a passage for communication and electrical wiring through the panel 94. The panel 94 is joined to the rear wall 92, the end panel 102 and optionally to the storage column 46 through conventional fasteners The organizer 44 also includes an end panel 102 which has an ornamental front edge 104 in the form of a concavely grooved surface 106.

The organizer 44 also includes a top panel 108 which extends from the end panel 102 to the storage column 46. A shelf unit, generally identified by the numeral 110 underlies the top panel 108 and extends between the end panel 102 and the storage column 46 as is best shown in FIG. 3. The shelf unit 110 has a number of open shelf compartments which can be used to organize files, papers and the like. In addition to or in lieu of the compartments, the organizer can include cabinets (not shown) and open shelves to organize work. The top panel 108 can be positioned at various heights to accommodate different functions. For example, the configuration shown in FIGS. 1–4 can have a height of six feet. Alternately, the height can be reduced to about 39–40" so that the top panel 108 can be used as a stand-up work surface. In this case, the top panel 108 would extend out to a point coextensive with the panel 94 and would have a convexly curved edge, like curving edge 74. A task light 78 can be mounted to the underside of the shelf unit 110 to illuminate the tackboard 93 and the panel 94.

The organizer has been shown as positioned at one side of the desk 42 and freestanding. If desired, the organizer can be connected through fasteners to the desk 42 and/or to the storage column 46. The organizer can also be positioned behind the worker, facing a desk, and can be wall mounted at either the side or back locations.

Figure 5:
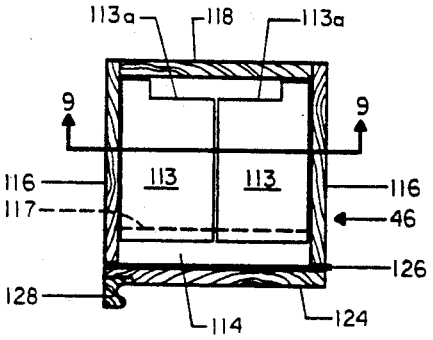
FIG. 5 is a fragmentary horizontal sectional view taken along the line 5—5 of FIG. 3 and shows the general construction of the column.
Figure 9:
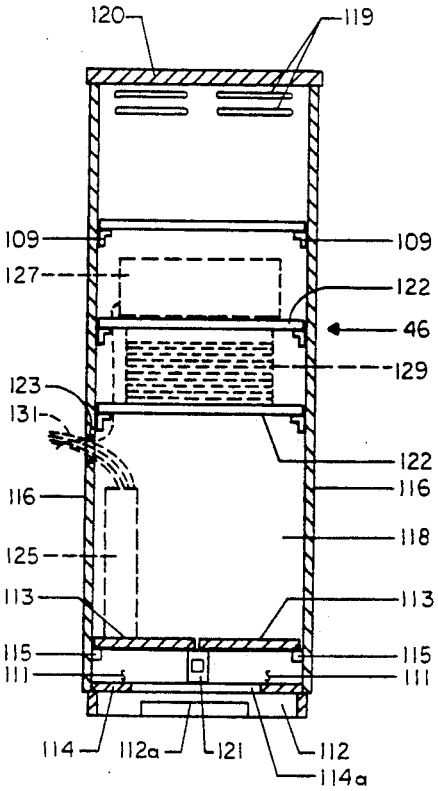
FIG. 9 is a front elevational view in section of the storage column of FIG. 1 seen along lines 9—9 of FIG. 5.
Figure 10:
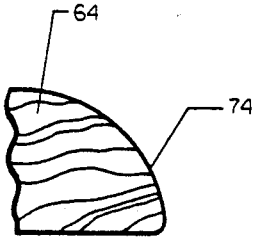
FIG. 10 is an enlarged fragmentary vertical sectional view taken generally along the lines 10—10 of FIG. 2 and shows a cross section of the edge of the working area of the desk.

As is best shown in FIGS. 5 and 9, the storage column 46 includes a base 112 in which there is seated a bottom wall 114 with there being upstanding sidewalls 116 connected together at the rear edges by a rear wall 118. The bottom wall 114 preferably has an open central portion 114*a* for air flow into the cabinet. There is also a top wall 120. Internally, the storage column 46 is provided with suitable shelving 122 which can be adjustably mounted in the sidewalls 116 through suitable fasteners 109.

The storage column 46 has an open front which is normally closed by a front door 124 hinged to the sidewalls 16 at hinges 126. As is best shown in FIG. 5, the left edge of the door 124 is provided with a vertically extending ornamental handle strip 128 which is of the same cross section as the strip which forms the handle 56. The handle strip 128 is mounted to the left side of the door 124 and functions as a handle.

A wire storage area 111 is provided at the bottom of the cabinet 46 by a pair of removable floor panels 113 which are mounted on cleats 115 secured to the sidewalls 116 and a front panel 117 which is mounted on the bottom wall 114. The floor panels 113 simply rest on the cleats 115 and front panel 117 so that they can be easily removed for access to wiring there beneath. A rectangular grommet 121 is mounted to the rear wall 118 beneath the floor panels 113 for ingress of electrical and communication wiring into the cabinet 46. The floor panels 113 have indented rear portions 113*a* to permit wiring to pass from the wire storage area into the cabinet interior above the floor panels 113. A grommet 123 is mounted in the sidewall 116 to provide a passage for electrical and communication wiring 131 between the interior of the column 46 and the storage space 88 beneath the panel 94.

As seen in FIG. 3, a computer terminal 134 can be positioned on the organizer panel 94 for use by a worker using the ensemble 40. The terminal 134 can be connected to the CPU 125 through the wiring 131 which passes first through the grommet 95 and then through the grommet 123. The CPU, in turn, can be connected to an electrical outlet (not shown) through a cord (not shown) which passes between the rear wall 118 and the recessed rear portions 113*a* to the wire storage area 111, and then through grommet 121.

The storage column 46 has been illustrated as adapted for an electronic intensive use. A CPU 125 is shown in phantom lines mounted vertically within the lower portion of the storage column on the removable floor panels 113. A printer 127 is shown in phantom lines mounted on the middle of the removable shelves 122. The lower of the shelves 122 is shown with paper 129 in phantom lines for feeding the printer 127.

The cabinet can be ventilated through the open central portion 114*a* of the bottom wall 114. Heated air can exhaust from the cabinet through the vent openings 119 at the top of the storage column. Openings 112*a* in the base 112 provide for the passage of air from the surrounding area into the storage column 46. Alternatively, the column can be mounted on glides (not shown) which raise the base 112 off the floor.

The shelves 122 are preferably of a depth less than the depth of the sidewalls 116 so that there exists ample air space between the front and back of the shelves 122 and the door 124 and rear wall 118, respectively.

The storage column 46 can be a freestanding unit or can be connected directly to the organizer 44 at the panel 94, the top panel 108 and the upstanding rear wall 92. The column 46 functions as an integral part of the work space in providing a storage area for electronic components which are used by the person who occupies the ensemble 40. Wire management is provided between the storage column 46 and the organizer 44 through the grommet 95 and 123. Natural ventilation is provided in the cabinet through the openings in the base 112, through the recessed rear portions 113*a* of the floor panels 113, through the open central portion 114*a*, bottom wall 114, around the shelves 122 and through the vent openings 119 In addition to the housing of the computer functions, sufficient storage space is left within the column 46 for storage of personal items and other work-related items. The hinged door 124 provides easy access to the column and yet closes off the storage space for a more pleasing appearance. Yet, the column functions to store the equipment and is easily accessible in the work space. The door is hinged at the right side, as viewed in FIG. 3, so that the door opens away from the work space so that the cabinet is easily accessible by the person working within the work space.

A keyboard tray (not shown) can be mounted beneath the work surface 94 for mounting a keyboard. Wires from the keyboard can also pass through the grommet 123 to the CPU 125.

In some offices, computers are not used. In these offices, the column can be reconfigured for paper-intensive activity. File drawers (not shown) can be mounted within the bottom portion of the column for storage of paper. The file drawers are easily accessible through the door 124. Removable shelves can also be provided in the upper portion of a paper-intensive column in the same fashion as the shelves 122 are provided in the column 46.

The desk 42 can be freestanding or can be connected to the organizer 44 through conventional fasteners (not shown) at the interface between these two components. Likewise, the storage column 46 can be freestanding or can be connected to the organizer 44 through suitable fasteners (not shown) at the interface between the storage column 46 and the organizer 46.

In FIG. 3 the base 112 of the storage column 46 is provided with a vertical outwardly projecting short section of strip 130 which is aligned with the strip or handle 128. Also, as is best shown in FIGS. 1 and 2, the top wall 120 of the storage cabinet 46 is provided with a projection 132 which is also aligned with the strips 128, 130 to complete the ornamental appearance of the corner of the storage column 46. The top wall 120 further has a front edge 133 which is coplanar with the outer surface of the door 124.

Figure 11:
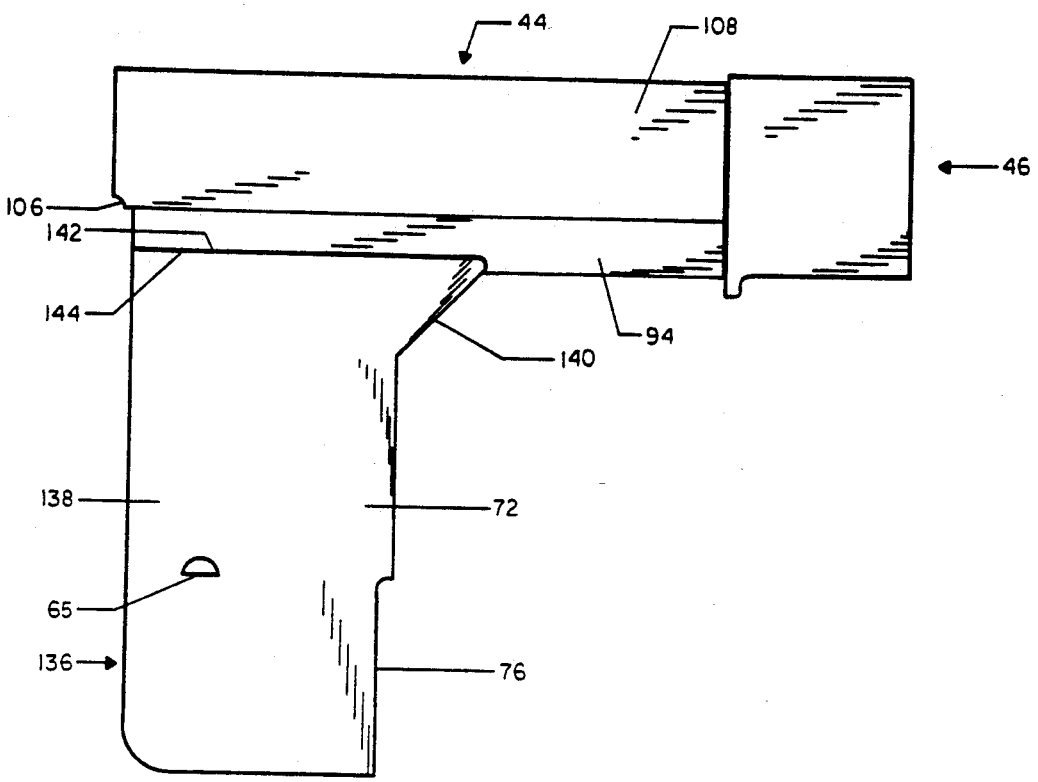
FIG. 11 is a plan view of a second modification of the furniture ensemble.

Referring now to FIG. 11, it will be seen that there is illustrated a modified furniture ensemble which includes a desk 136 in combination with the organizer 44 and the storage column 46. The difference between the furniture ensemble 134 and the furniture ensemble 40 is primarily in the contour of a flat panel forming a desk top 138. As compared with the desk top 64 in FIG. 2, the desk top 138 is longer and adjacent the user portion 76 there is an extension which tapers diagnally as at 140 towards the panel 94. The extension can be used to support a computer keyboard. The net result is that the desk top 138 has an end 142 which is much longer than the end 68. In addition, the panel 94 of the organizer 44 has a notch 144 which matches the extent of the end 142.

Figure 12:
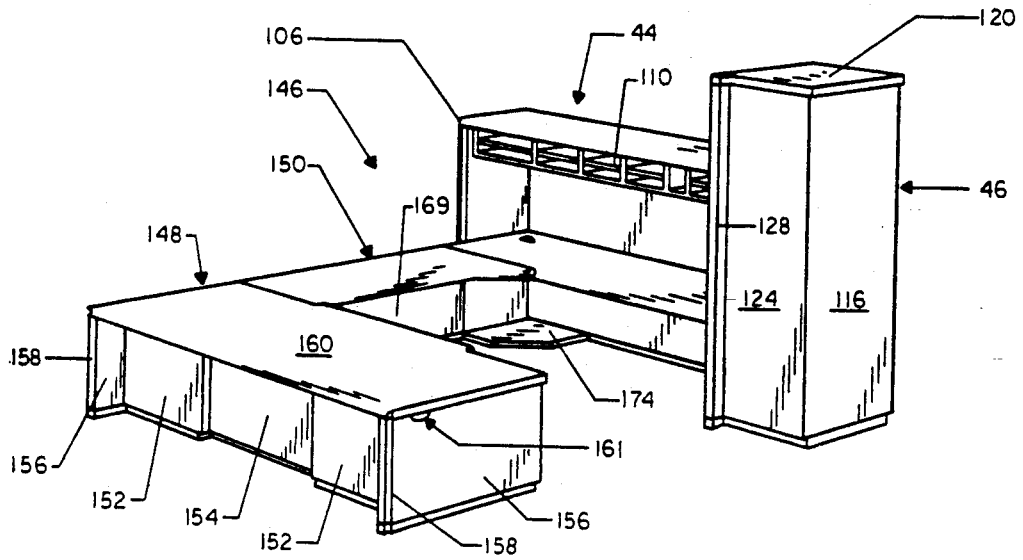
FIG. 12 is a top perspective view of a third embodiment of a furniture ensemble of the invention.
Figure 13:
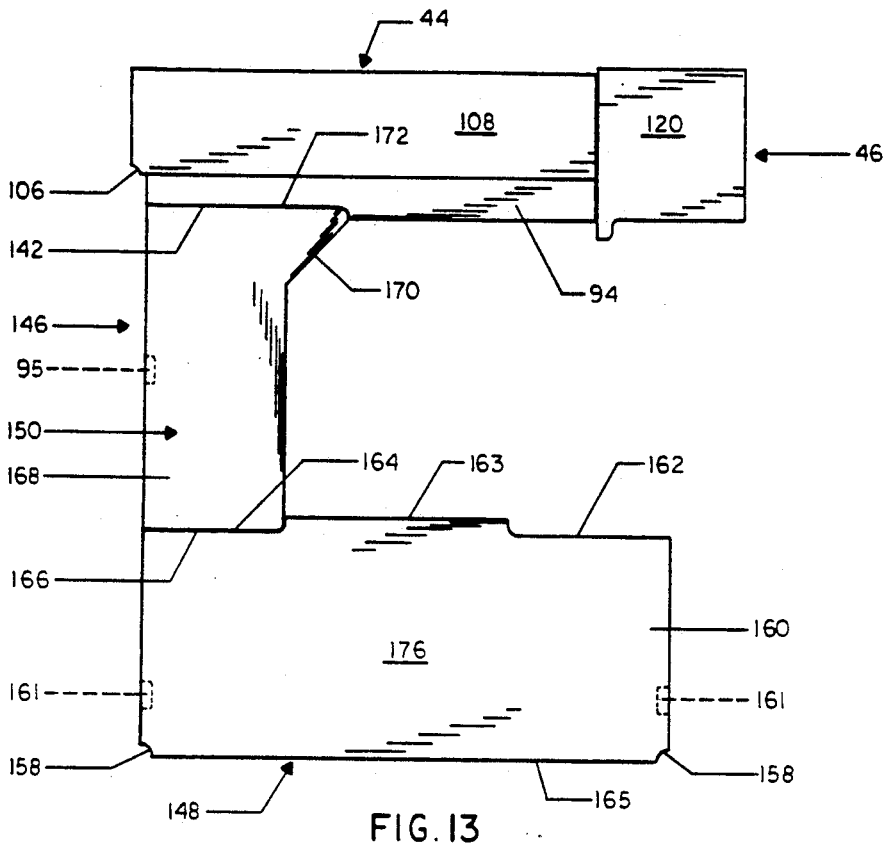
FIG. 13 is a plan view of the furniture ensemble of FIG. 12.

Referring now to FIGS. 12 and 13, it will be seen that there is illustrated another form of furniture ensemble generally identified by the numeral 146. The furniture ensemble once again includes an organizer 44 and a storage column 46. However, while there is a desk 148, the desk 148 is in spaced parallel relation with respect to the organizer 44 and is separated from the organizer 44 by a return or bridge 150. The illustrated desk 148 is of a more conventional configuration and includes two pedestals 152 which are recessed at the front of the desk and have extending between the forward portions thereof a further recessed modesty skirt 154.

The desk 148 also includes end panels 156 which have contoured corners 158 which match the corner 106 of the organizer 44. Wire management grommets 161 are provided in the side panels 156 near the top to permit passage of wiring from the interior of the desk to the top surface.

The desk 148 also includes a flat panel in the form of a desk top 160. As is best shown in FIG. 13, the desk top 160 has formed in the front edge thereof two notches 162, 164. The notch 162 is aligned with the pedestal 152 which may be a drawer pedestal while the notch 164 receives an end 166 of a top 168 of the return 150 in the manner previously described with respect to FIG. 2.

The opposite end of the return top 168 is rearwardly flared to provide a diagonal corner and a wide end 172 for mounting a computer keyboard (not shown). The end 172 is seated in the notch 142 of the organizer 4 shown in FIG. 11. A back wall 169 is mounted beneath the return top 168 in supporting relationship thereto. A grommet 95 is mounted to the back wall 169 at an upper portion thereof to pass wiring from beneath the return top 168 to the upper surface thereof.

The furniture ensemble 146 may also include a lower shelf 174 in the corner between the table 150 and the organizer 140 as shown in FIG. 12 for receiving a computer or like electronic equipment or personal items.

It is to be understood that the desk top 160 will have a work area 176 between the notches 162, 164. The work area 176 will preferably terminate in a downwardly and forwardly convexly curved edge 163 as shown, for example, in FIG. 10. In a like manner, the back edge 165 of the desk top 160 will also be downwardly convexly curved but sloping backwardly.

Figure 14:
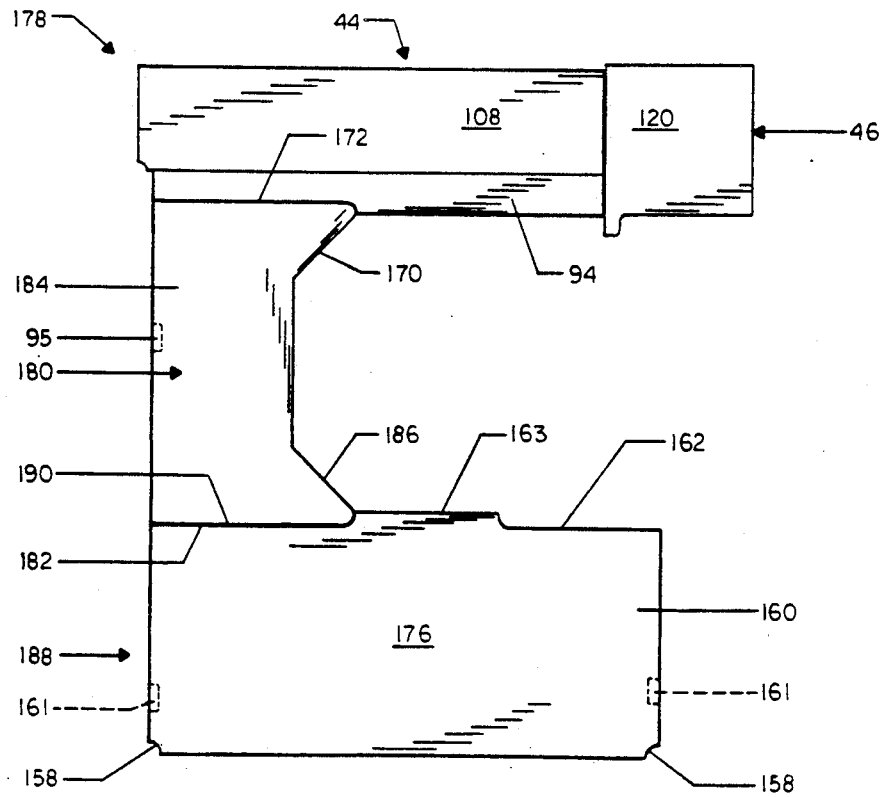
FIG. 14 is a plan view of a fourth embodiment of furniture ensemble of the invention.

Referring now to FIG. 14, it will be seen that there is illustrated a furniture ensemble generally identified by the numeral 178. The furniture ensemble 178 will be substantially identical to the furniture ensemble 146 with one exception. The furniture ensemble 178 includes the slightly modified organizer 44 and the storage column 46. The furniture ensemble 178 also includes a return or bridge 180 which is a modification of the return or bridge 150 to the extent that an end 182 of a return or bridge top 184 corresponding to the end 166 is also of an increased length due to the tapering and width of the return or bridge top 184 to form a diagonal corner 186. A keyboard can be mounted either on diagonal corner 186 or on diagonal corner 170. Grommets 161 in the end panels 156 near the top provide a passage for wires between the upper surface of the desk top 160 and the interior of the desk 148 for management of wiring. This results in a desk, generally identified by the numeral 188 being a slight modification of the desk 148 in that the equivalent of the notch 164 is replaced by an elongated notch 190 and the work area 176 being shortened.

Figure 15:
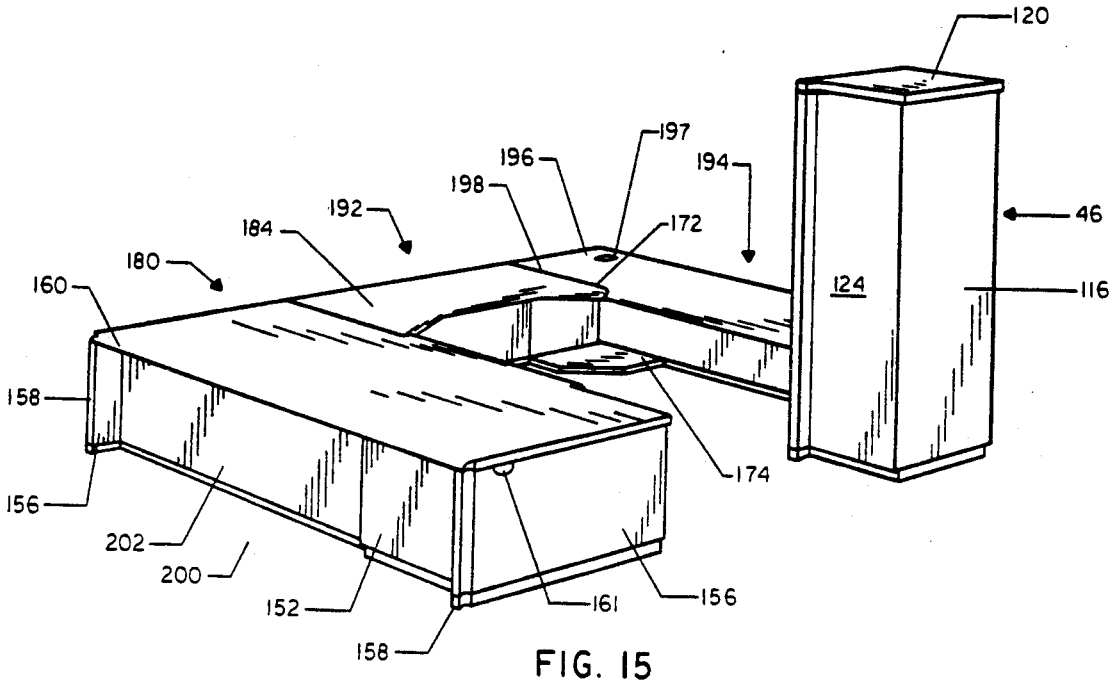
FIG. 15 is a top perspective view of a fifth embodiment of furniture ensemble of the invention.
Figure 16:
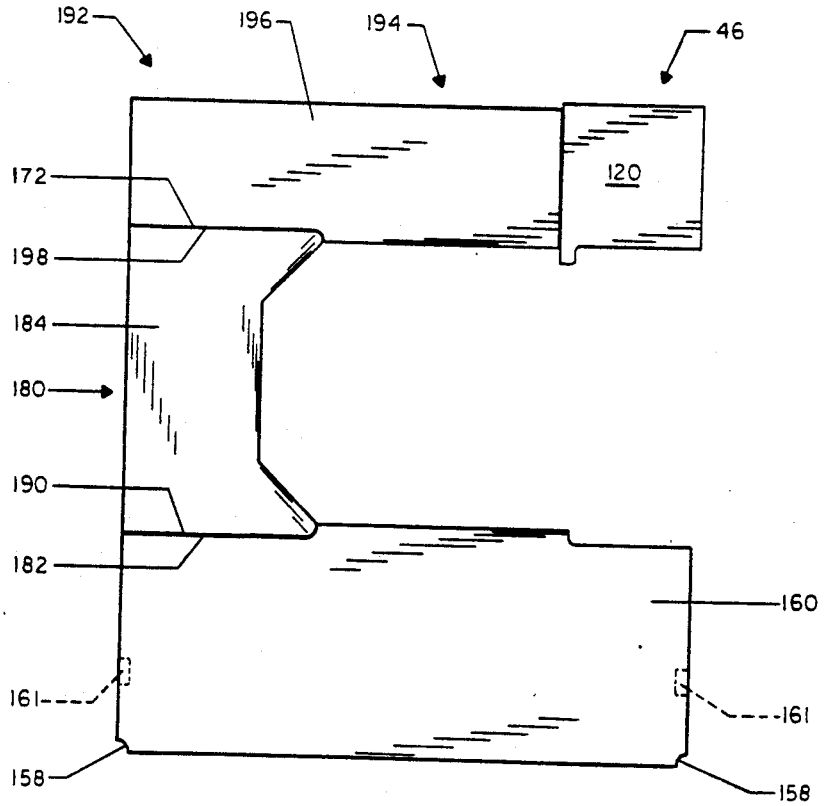
FIG. 16 is a plan view of the furniture ensemble of FIG. 15.

Reference is now made to FIGS. 15 and 16 where there is illustrated another form of furniture ensemble 192 in accordance with this invention. The furniture ensemble 192 is substantially the same as that of the furniture ensemble 178 of FIG. 14 except that the organizer 44 has been replaced by a low level storage unit 194 having a flat panel forming a top 196 which corresponds to the organizer panel 94. The top 196 is notched at 198 to receive an end 172 of the top 184 of the bridge 180. At an end of the storage unit is the storage column 46.

In the corner between the table 190 and the storage unit 194 is a low storage shelf 174 which corresponds to the shelf 174 of FIG. 12.

The furniture ensemble 192 also includes a desk generally identified by the numeral 200 which differs from the desk 148 only that it is provided with the single pedestal 152 and the front thereof is formed by an elongated modesty skirt 202.

Figure 17:
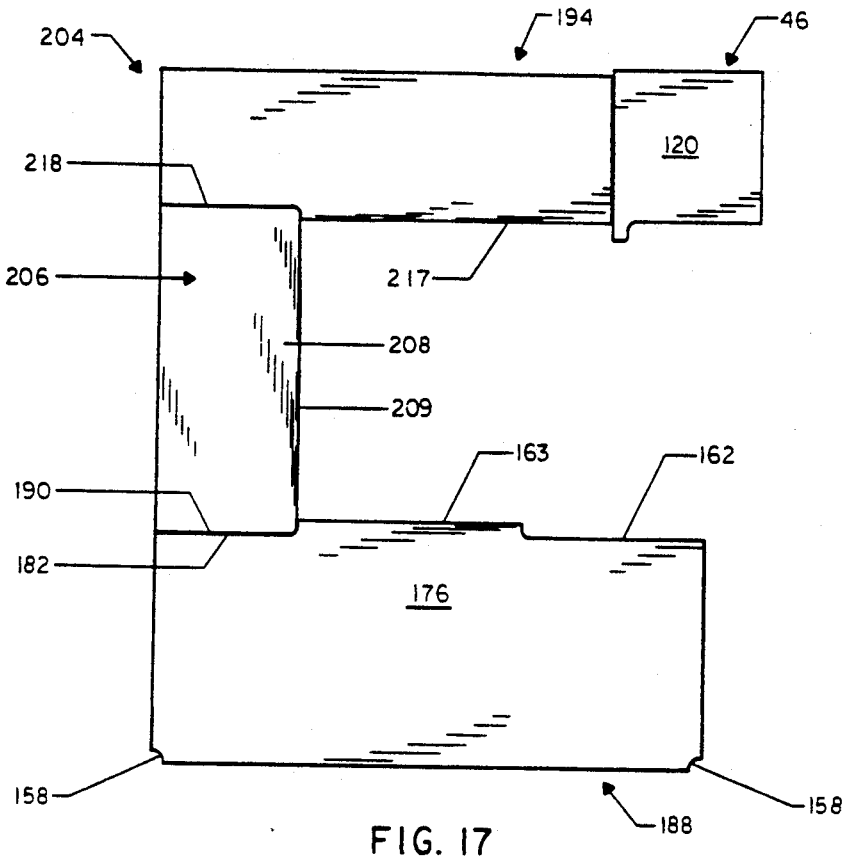
FIG. 17 is a plan view of a modification of the furniture ensemble FIGS. 15 and 16.

Referring now to FIG. 17, it will be seen that there is illustrated a furniture ensemble generally identified by the numeral 204. The furniture ensemble differs from the furniture ensemble 192 of FIGS. 15 and 16 only in that the bridge or return has been modified The return 180 has been replaced by a bridge 206 which has a bridge top 208 which is rectangular in cross section and thus of a constant width. A rounded front edge 209 like edge 96 (FIG. 4) is provided on bridge top 208 to indicate a user work area.

The furniture ensemble 204 also includes a desk which may correspond either to the desk 188 or the desk 200.

Figure 18:
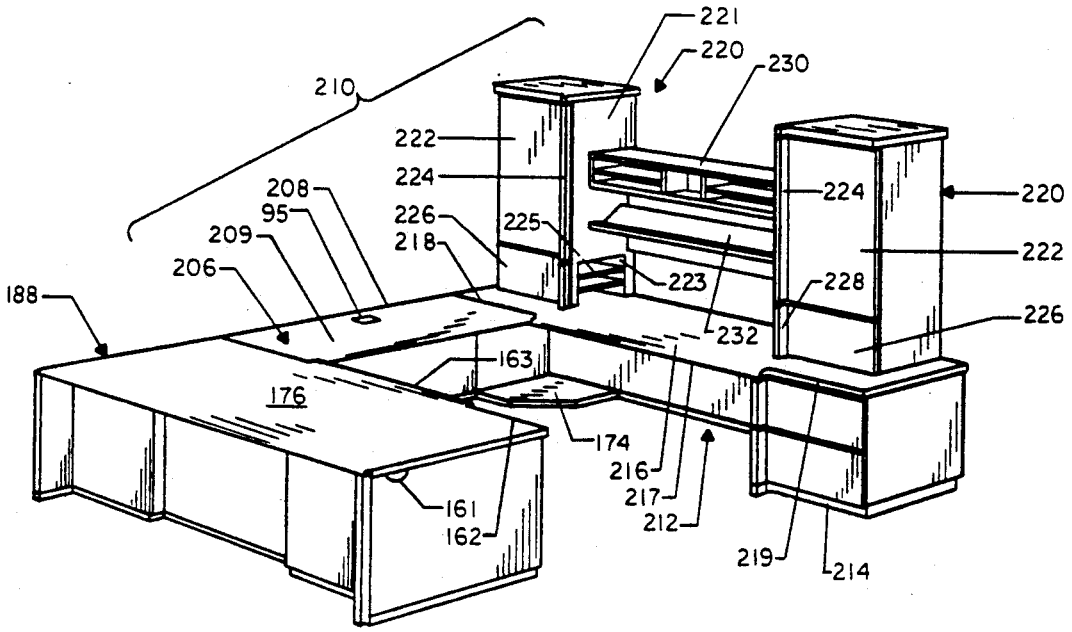
FIG. 18 is a top perspective view of a sixth embodiment of furniture ensemble of the invention.
Figure 19:
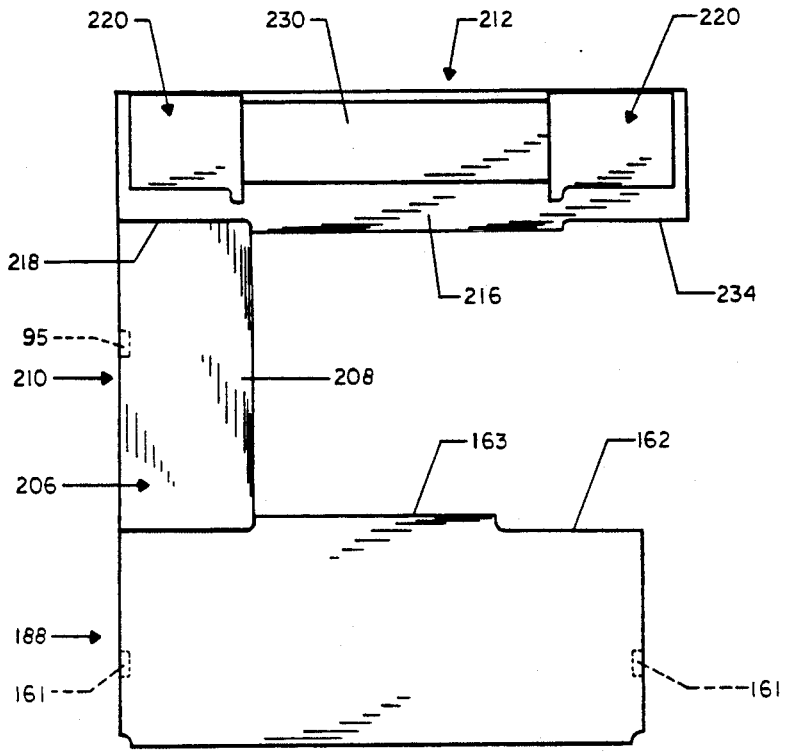
FIG. 19 is a plan view of the furniture ensemble of FIG. 18.

Referring now to FIGS. 18 and 19, there is illustrated another furniture ensemble generally identified by the numeral 210. The furniture ensemble 210 includes the desk 188 and the rectangular table 210 which are connected together in the aforedescribed notched relationship. On the other hand, the storage unit 194 and the storage column 46 have been replaced by a credenza 212 which includes one drawer pedestal 214 which corresponds to the drawer or pedestal 50 but is of a left hand version.

The credenza 212 includes a flat panel forming a top 216 with the top being notched as at 218 for receiving the end of the table top 208. The panel is also notched at 219 above the drawers of the pedestal 214 as is the desk 42. The central portion 217 of the top 216 is rounded as edge 74 of desk 42 to indicate a user work area. Likewise, the entire front edge 209 of the bridge 208 is rounded as edge 96 (FIG. 4) to indicate a user work area.

There is also a lower shelf 174 in the corner between the table 206 and the credenza 212 for receiving a computer or other electronic equipment or personal items The credenza 212 carries two truncated storage columns 220 which correspond generally to the storage columns 46 but is shorter in height Further, the storage columns 220 have upper doors 222 which are hinged and which are provided along vertical free edges thereof with an ornamental strip 224 which functions as a handle in the generally aforedescribed manner. The hinges for the doors 222 are mounted opposite the handle strip 224 so that the doors open away from the work area. Below each door 222 is a short panel 226 which is either fixed or is in the form of a lower door. Each of the panels 226 has along the edge thereof in vertical alignment with the strip 224 a further vertical strip 228.

The truncated storage columns 220 have a top of similar construction as the top 120 of column 46 with a projection in alignment with the strip 24. An opening 223 is provided in the bottom of sidewalls 221 of the storage column 22 to provide access to shelves 225 mounted in the bottom of the column 220. The shelves 225 provide semi-hidden paper storage.

An organizer unit 230 extends between upper portions of the sidewalls 221 of the truncated storage columns 220 and below the organizer unit 230 is a display shelf 232 which can carry a light fixture if so desired. The organizer has a number of openings for paper and files, and is joined at the ends thereof to the sidewalls 221 of the columns 220. Likewise, the display shelf 232 is joined at its ends to the side 221 of the columns 220.

Figure 20:
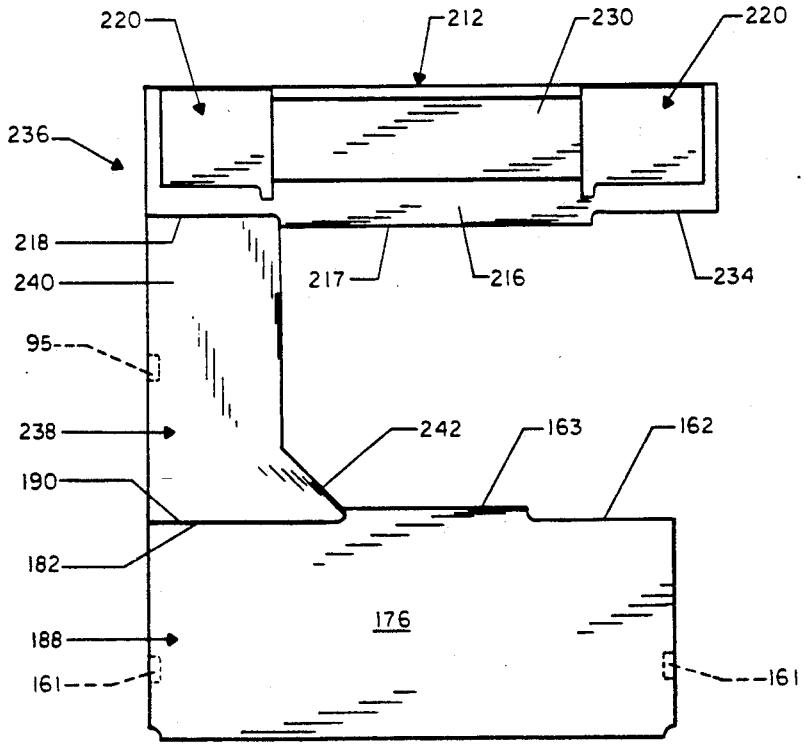
FIG. 20 is a plan view of a modification of the furniture ensemble of FIG. 19.

Referring now to FIG. 20, it will be seen that there is illustrated a furniture ensemble 236 which is identical with the furniture ensemble 210 except for a modified construction of a table 238. The table 238, in particular, differs from the table 206 in that in lieu of a rectangular table top, the table top 240 has a flared end to form a diagonal corner for a computer keyboard. The notch 90 is sized to accommodate the full length of end 182.

Figure 21:
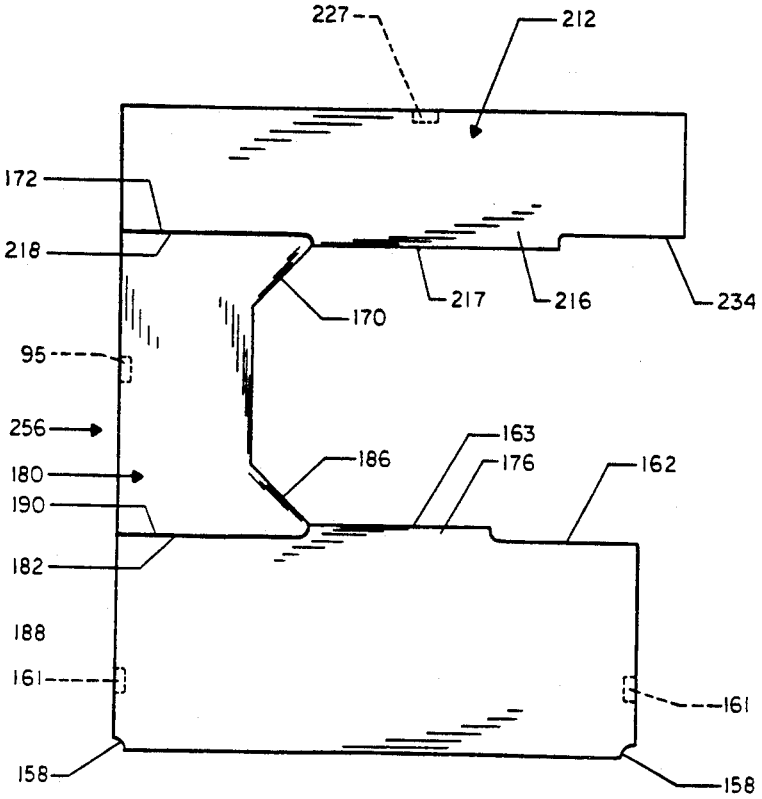
FIG. 21 is a plan view of a slightly modified form of a seventh embodiment of the invention.

Reference is now made to FIG. 21 wherein there is illustrated a furniture ensemble generally identified by the numeral 256. This furniture ensemble includes a desk 188, a return or bridge 180 and a credenza 212. The notch 218 in the credenza has been widened to receive the end 172 of the return 180. A grommet 227 is positioned in the back wall of the credenza 212 near the top thereof to pass wiring between the interior of the credenza and the upper surface of the top 216. The view clearly shows the interchangeability and adaptability of the different pieces of furniture.

Figure 22:
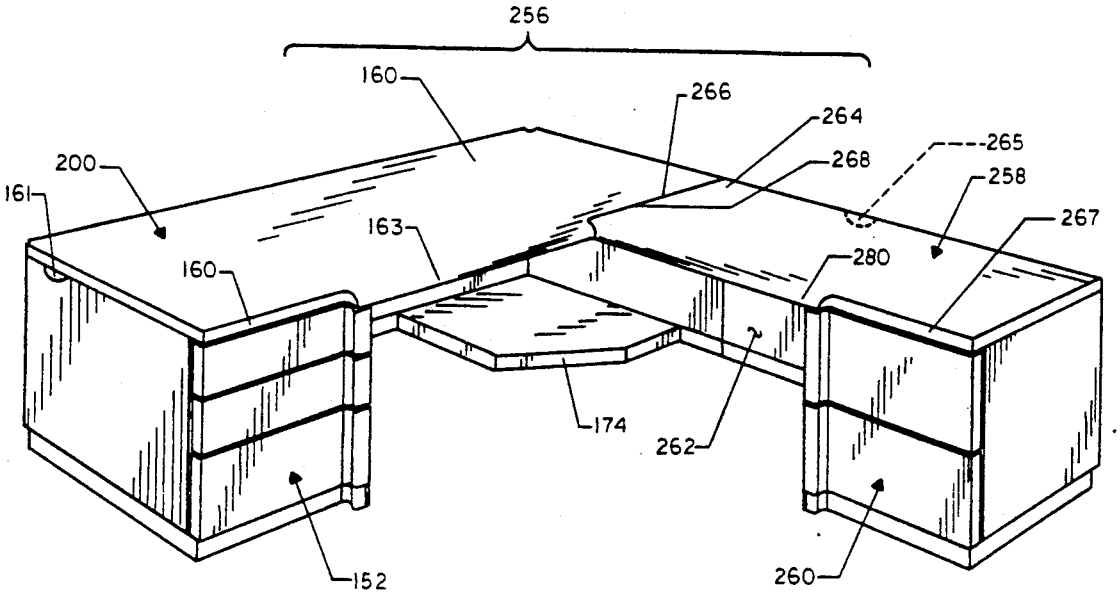
FIG. 22 is a top perspective view of an eighth embodiment of furniture ensemble of the invention.

Reference is now made to FIG. 22 wherein there is illustrated a furniture ensemble 256 which is formed of the desk 200 and a modified form of the credenza 258. The credenza has at one end a drawer pedestal 260 and at the other end a storage area 262 extending towards the desk 200. Overlying the drawer pedestal 260 and the storage area 262 is a credenza top panel 264 having an end 266 which is received in a customary notch 268 in the front right edge portion of the desk top panel 160. The top panel 264 has a notch 267 at one end of the front edge overlying the drawer pedestal 260. A grommet 265 is positioned in the top of the credenza back wall to provide a passage for wires between the top surface and bottom surface of the top panel 264.

If desired, there may also be a lower shelf 174 for receiving a computer or like electronics or for storage of personal items.

Figure 23:
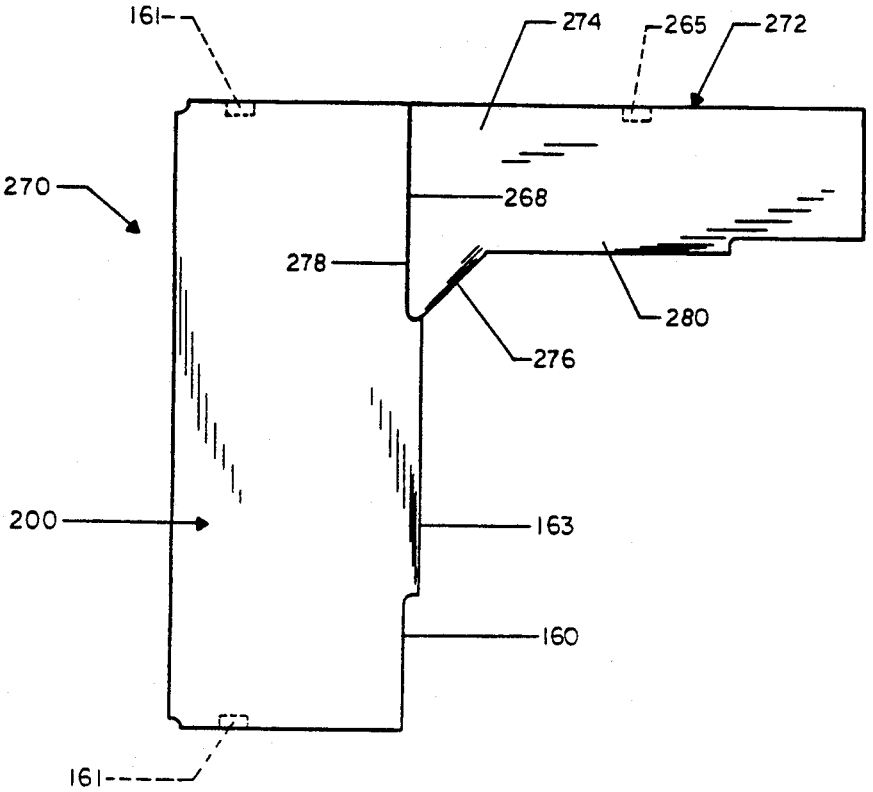
FIG. 23 is a plan view of a slightly modified form of the furniture ensemble of FIG. 22.

Reference is now made to FIG. 23 wherein there is illustrated another modified form of furniture ensemble 270 which includes the desk 200 and a credenza 272 which is very similar to the credenza 258 but wherein a left end of a modified form of credenza top 274 has a diagonal corner 276 for a computer keyboard The only change required in the desk 200 is an elongation of the notch 268 to receive an elongated end 278 of the credenza top 274. A grommet 265 is mounted in the upper portion of the back wall 262 of the credenza 258 to pass wiring from the interior of the credenza to the upper surface thereof.

The credenza tops 264 and 274 are provided with a downwardly convexly curved edge 280 so as to invite the use of the adjoining area as a work surface by one sitting before the desk 200.

Figure 24:
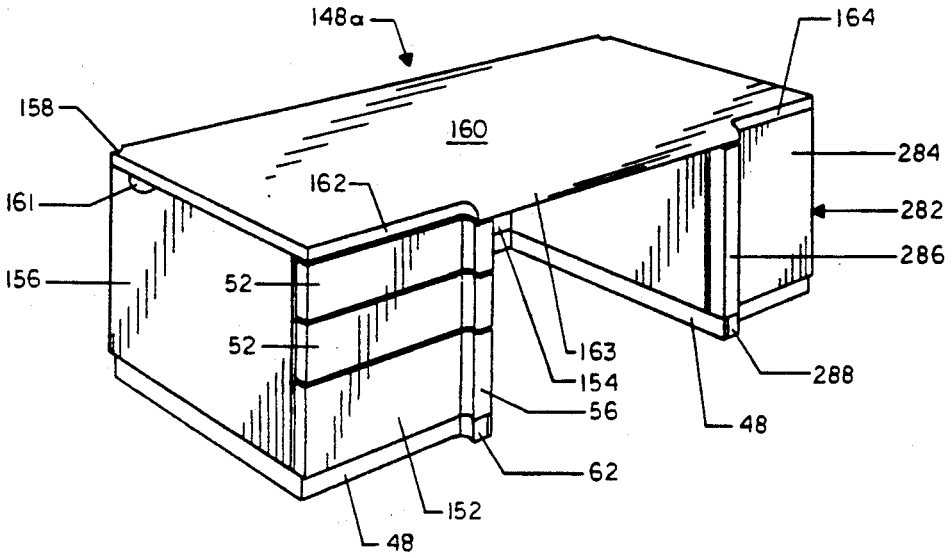
FIG. 24 is a top perspective view of a desk formed in accordance with this invention.

Referring now to FIG. 24, a desk 148*a* has at one end thereof a drawer pedestal 152 and at the opposite end thereof a compact pedestal 282. The front of the desk 148 is like that shown in FIG. 12 with the desk including a base 48 and a pair of side panels 156. The pedestals 152, 282 are separated by a modesty skirt 154. The desk end panels 156 include grommets 161 for wire management.

The illustrated desk 148 differs at the most from that shown in FIG. 12 in that the second pedestal, now identified by the numeral 282 is in the form of a compact pedestal which will be described later with reference to FIG. 32. The door 284 is provided along a free edge thereof with an ornamental strip 286 which functions the handle. Further, the base 48 in generally vertical alignment with the strip 286 carries an ornamental projecting strip 288.

The front edge of the desk top 160 is provided with the customary notches 162, 164 adjacent opposite ends thereof while there is an intermediate downwardly and forwardly projecting convexly curved portion 163 which defines a user interface which may be used as a work area or conference area.

The two rearward corners of the desk 148 are concavely contoured as at 158. Further, it is preferred that the rearward edge of the desk top 160 be rearwardly and downwardly convexly curved to provide an inviting area at the front of the desk for a conference area.

Figure 25:
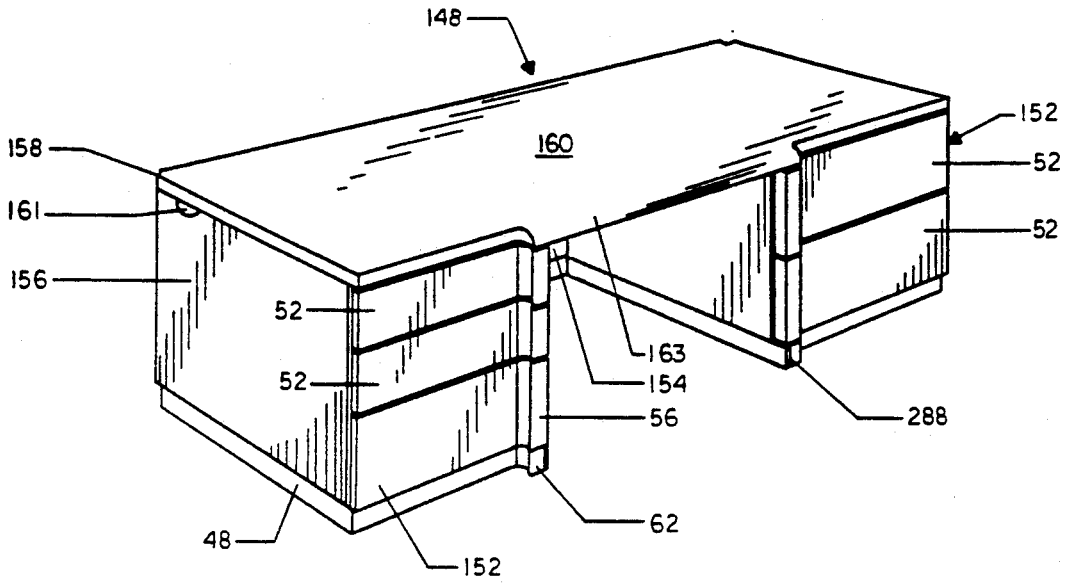
FIG. 25 is a top perspective view of a modification of the desk of FIG. 24.

The configuration of the desk illustrated in FIGS. 24 and 25 provides an inviting portal beneath the rounded edge 163 and between the pedestals 152. If desired, the rounded edge portion 163 can be recessed inwardly of the notches 162 and 174 to have a similar impact In this event, the drawer handle 56 would be formed inwardly rather than outwardly.

Reference is now made to FIG. 25 wherein there is illustrated another form of the desk 148 incorporating the same desk top 160 and the drawer pedestal 152 but wherein a storage pedestal 282 has been replaced by another drawer pedestal 152 which is illustrated as having only two drawers 52 as opposed to the three drawer construction of the drawer pedestal 152 at the left of the desk.

Figure 26:
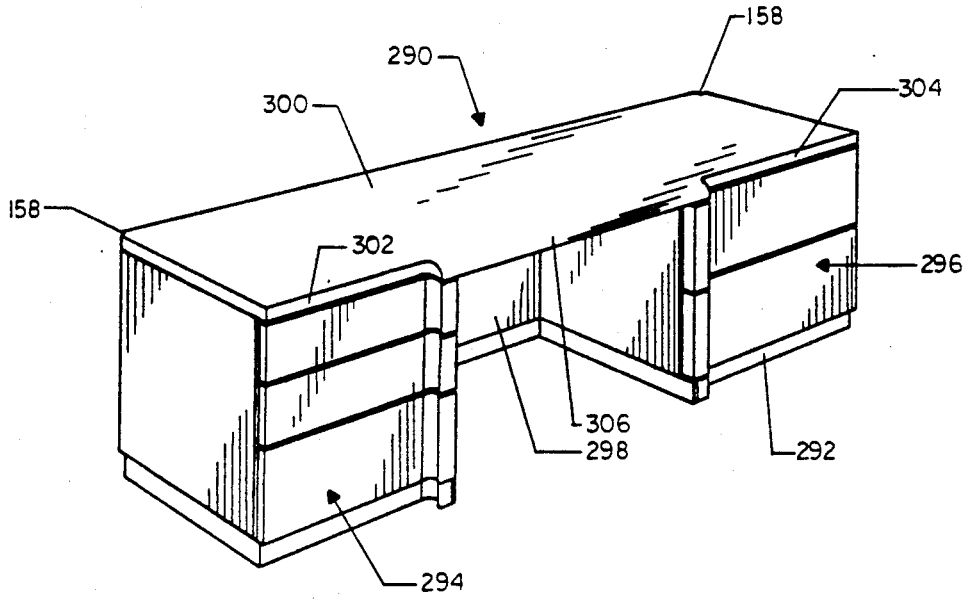
FIG. 26 is a top perspective view of a credenza formed in accordance with this invention.

Referring now to FIG. 26, it will be seen that there is illustrated a credenza 290 which includes a base 292 on which there is seated two drawer pedestals 294, 296 which are of the same type as the drawer pedestals 152 illustrated in FIG. 25. The drawer pedestal 294 differs from the drawer pedestal 296 in that it has three drawers whereas the drawer pedestal 296 has two drawers.

A rear wall 298 extends between the pedestals 294, 296 and a credenza top 300 overlies the pedestals 294, 296 and the rear wall 298.

The rear corners of the credenza 290 are concavely contoured as at 158 in a previously described manner while the pedestals 294, 296 are of a construction previously described and illustrated, for example, in FIG. 25.

The credenza top 300 is of a configuration similar to the desk top 160 and has in the front edge thereof notches 302, 304 in alignment with the respective pedestals 294, 296. The front edge of the credenza top 300 between the notches 302, 304 is forwardly and downwardly convexly curved as at 306 so as to define an inviting area between the pedestals 294, 296 which may serve as a work surface or conference area. A grommet (not shown) for wire management control can be mounted in an upper portion of the back wall 298. The space between the pedestals 294, 296 is open for leg room for a user.

Figure 27:
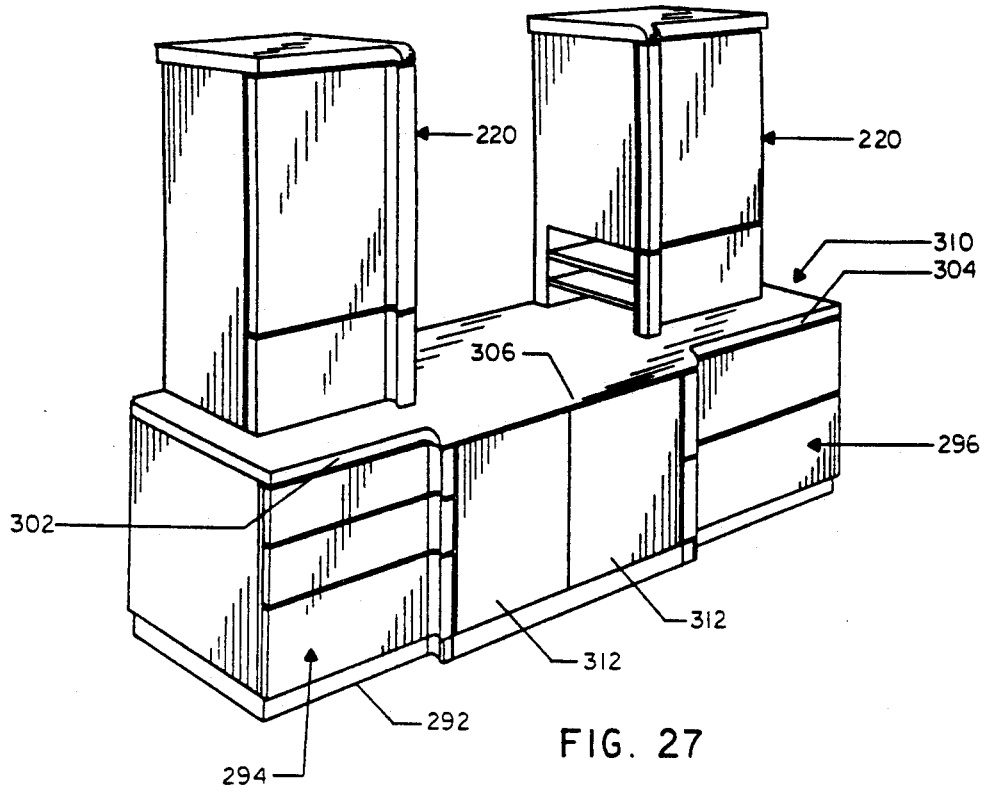
FIG. 27 is a top perspective view of a modified form of the credenza of FIG. 26 having a pair of truncated columns mounted thereon.

Referring now to FIG. 27, a slightly modified form of credenza generally identified by the numeral 310 is shown. The credenza 310 differs from the credenza 290 in that the base 292 continues in front of the open space between the pedestals 294, 296 and that open space is closed by a pair of doors 312.

The credenza 310 has seated thereon in generally overlying relation with respect to the pedestals 294, 296 a pair of mirror image truncated storage columns 220 which are identical with the previously described storage columns 220.

Figure 28:
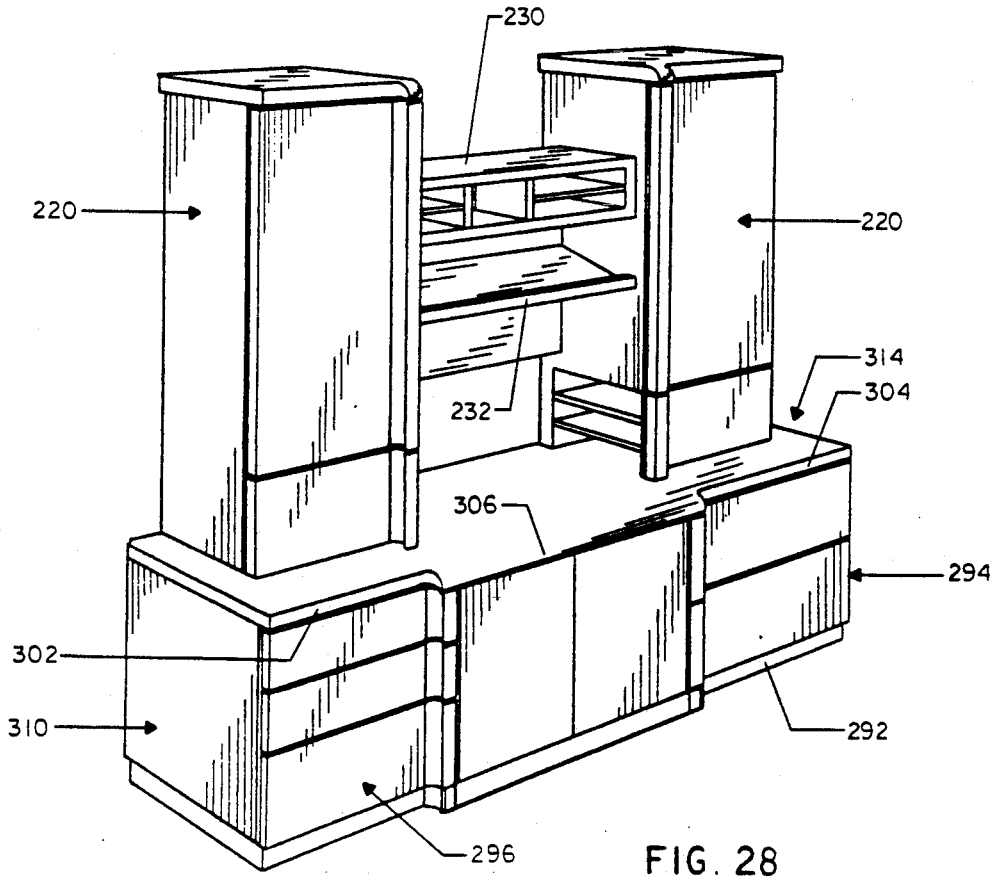
FIG. 28 is a top perspective view of a modification of the column and credenza combination of FIG. 27.

Reference is now made to FIG. 28 wherein there is illustrated a furniture ensemble 314 which is formed of the credenza 310 having mounted thereon the two spaced truncated storage columns 220. Further, extending between and being supported by the storage columns 220 is an organizer unit 230 and a shelf 232 as is more specifically illustrated and described in FIG. 18.

Figure 29:
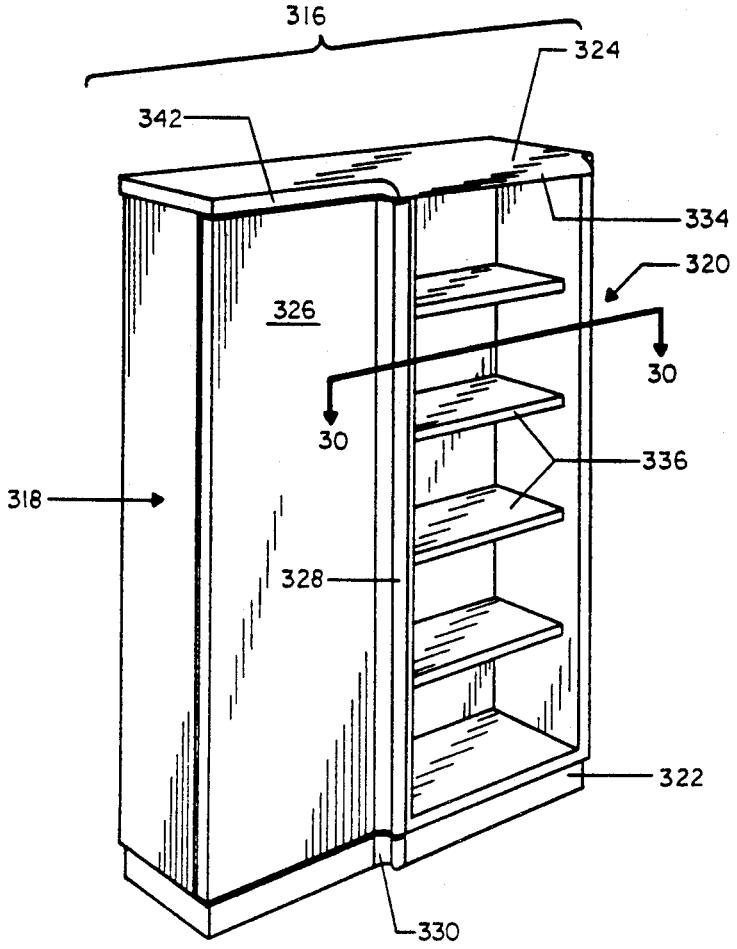
FIG. 29 is a top perspective view of a column and bookcase combination according to the invention.

Referring now to FIG. 29, there is illustrated another furniture ensemble 316 which is a combination of a storage column 318 and bookcase 320 having a common base 322 and a common top 324. The storage column 318 is of the same basic construction as the storage column 46 except that its door 326 opens to the left away from the bookcase 320 with the result that the Ornamental strip 328 forming the handle for the door 326 also functions generally as a center divider for the furniture ensemble 316. As in other constructions, the base 322 also has an ornamental strip 330 vertically aligned with the ornamental strip 328.

Figure 30:
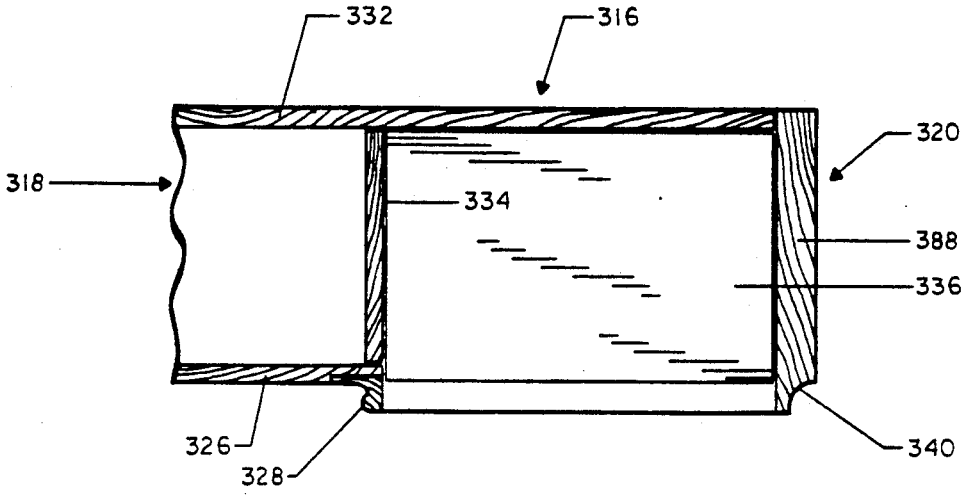
FIG. 30 is a fragmentary horizontal sectional view taken generally along the line 30—30 of FIG. 29 and shows the details of the door handle of the column and a front corner of the bookshelf.

As is best shown in FIG. 30, the storage column 318 and the bookcase 320 share a common back 332. Also, it will be seen that a common divider panel 334 forms the right side of the storage column 318 while also serving as a support for the individual shelves 336.

Finally, the right side of the bookcase 320 is formed by a rather thick side panel 338 which has the front corner thereof machined to an arcuate concave configuration 340 to provide an ornamental appearance.

Returning now to the top 324, a notch 342 is in alignment with the door 326 while a forwardly and downwardly convex arcuate edge 44 is in alignment with the shelves 336 to enhance the ornamental appearance thereof and so as to match other furniture configurations.

Figure 31:
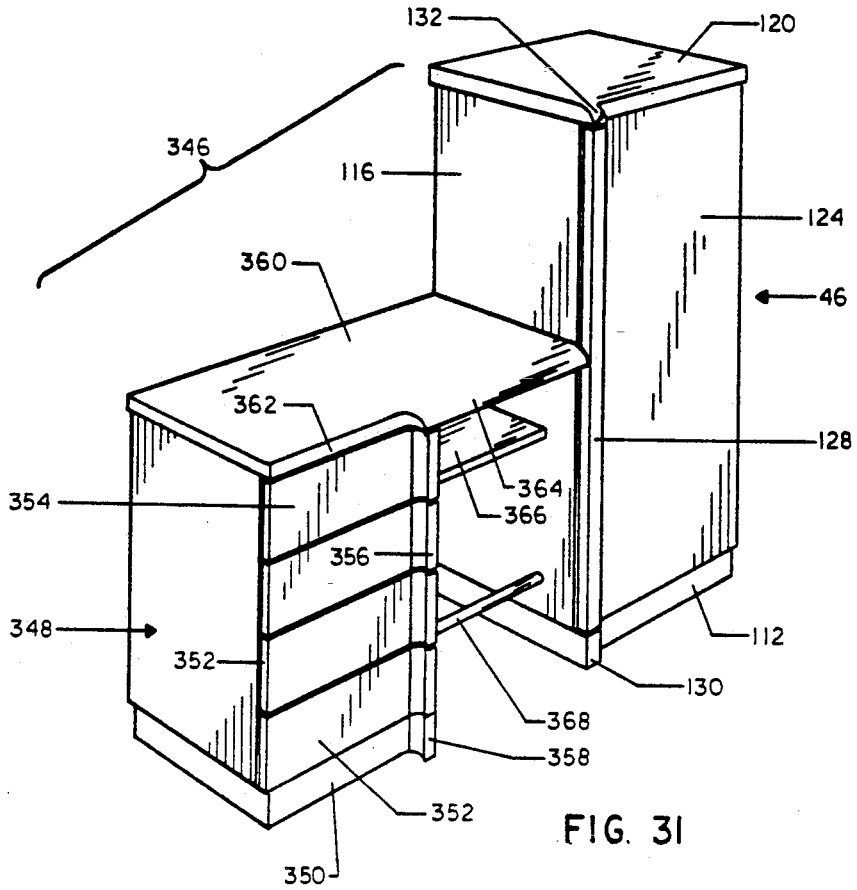
FIG. 31 is a top perspective view of a stand-up desk and column combination according to the invention.

Reference is now made to FIG. 31 wherein there is illustrated a stand-up desk ensemble 346 which includes a high drawer pedestal 348 having a base 350. The pedestal 348 has a plurality of drawers 352 of which each has a drawer front 354. Each drawer front 354 is provided along one vertical edge thereof with an ornamental strip 356 which functions as a handle. The construction of the drawer front and ornamental strip is similar to that shown in FIG. 6.

In order to enhance the ornamental appearance of the drawer pedestal 348, there is also an ornamental strip 358 of the same cross section as the ornamental strip 356 carried by the base 350 in vertical alignment with the ornamental strips 356.

In adjacent spaced relation to the pedestal 348 is a storage column 46 as previously described. The pedestal 348 has a top 360 of which a left hand portion is seated on the pedestal 348 and the right hand edge is connected to and supported by a sidewall 116 of the storage column 46. In accordance with other furniture construction which is the subject of this invention, the top 360 is provided with a notch 362 in alignment with the drawers 352 and the front edge of the top 360 between the notch 362 and the end wall 116 is machined so as to form a convexly forwardly and downwardly curved edge 364. Also, a shelf 366 is mounted between the pedestal 348 and the storage column 46 in underlying relation to the top 360. Finally, a foot rail 368 extends between the pedestal 348 and the storage column 46. A grommet (not shown) can be provided in the back wall to provide a passage for wiring between the upper surface of the top 360 and the open area therebeneath.

Figure 32:
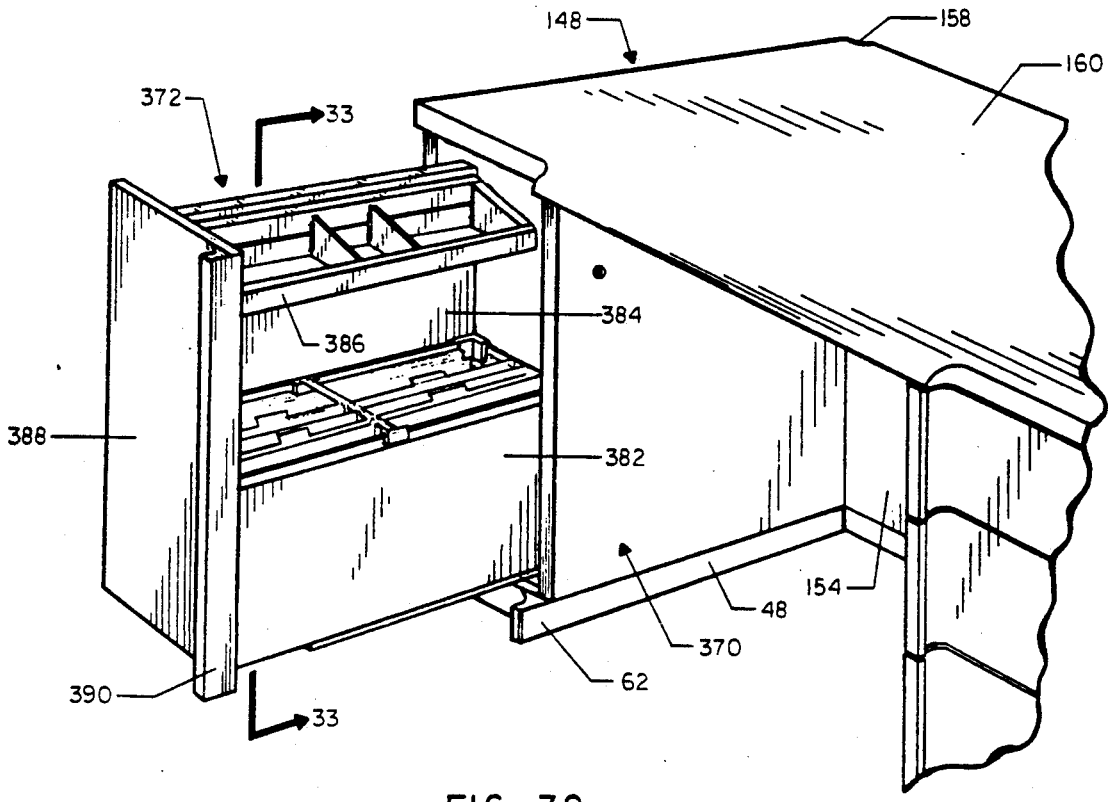
FIG. 32 is a partial top perspective view of a desk having a pedestal in the form of an organizer cabinet.
Figure 33:
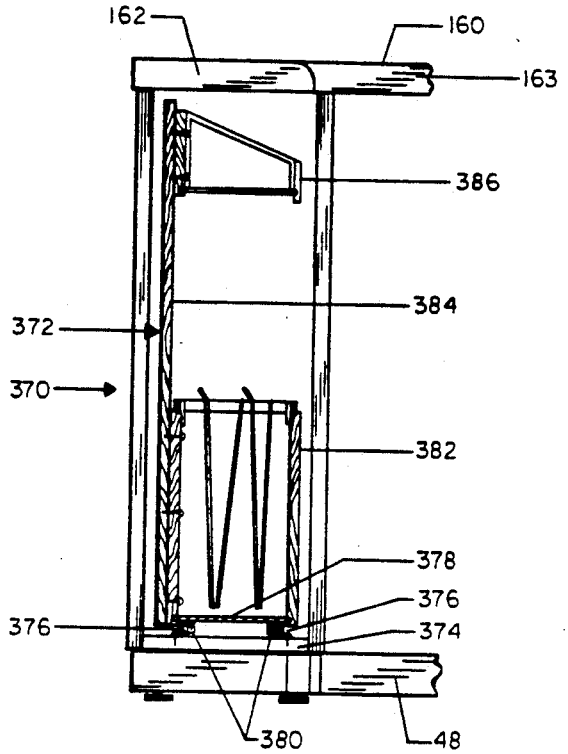
FIG. 33 is an enlarged fragmentary vertical sectional view taken generally along the line 37—37 of FIG. 36 and shows further details of the organizer.

Reference is now made to FIGS. 32 and 32 wherein there is illustrated a modified form of the desk 148 wherein the left pedestal is replaced by a compact pedestal generally identified by the numeral 370. The compact pedestal 370 is of the same general outline construction as previously described pedestals, but is in the form of an organizer cabinet which includes a pull-out organizer unit 372. As is best shown in FIG. 33, the pedestal 370 includes a bottom wall 374 which carries a pair of guide rails 376. The organizer unit 372 includes a base wall 378 which includes a pair of roller supports 380 which cooperate with the guide rails 376 to permit the organizer unit 372 to be readily pulled in and out.

The organizer unit preferably includes a lower file cabinet 382 carried by the base wall 378. An upstanding panel 384 is secured to one side of the file cabinet 382 and supports adjacent the top thereof a tray assembly 386.

The organizer unit 372 also includes a front door panel 388 which is suitably attached to the base wall 378, the file cabinet 382, the upstanding panel 384 and the tray assembly 386 for movement as a unit. The door panel 388 has at the right edge thereof a vertically disposed ornamental strip 390 which functions as a handle for the organizer unit 372. It will be seen that the ornamental strip 62 carried by the base 48 as in other desk constructions will be vertically aligned with the ornamental strip 390 and of the same configuration.

Figure 34:
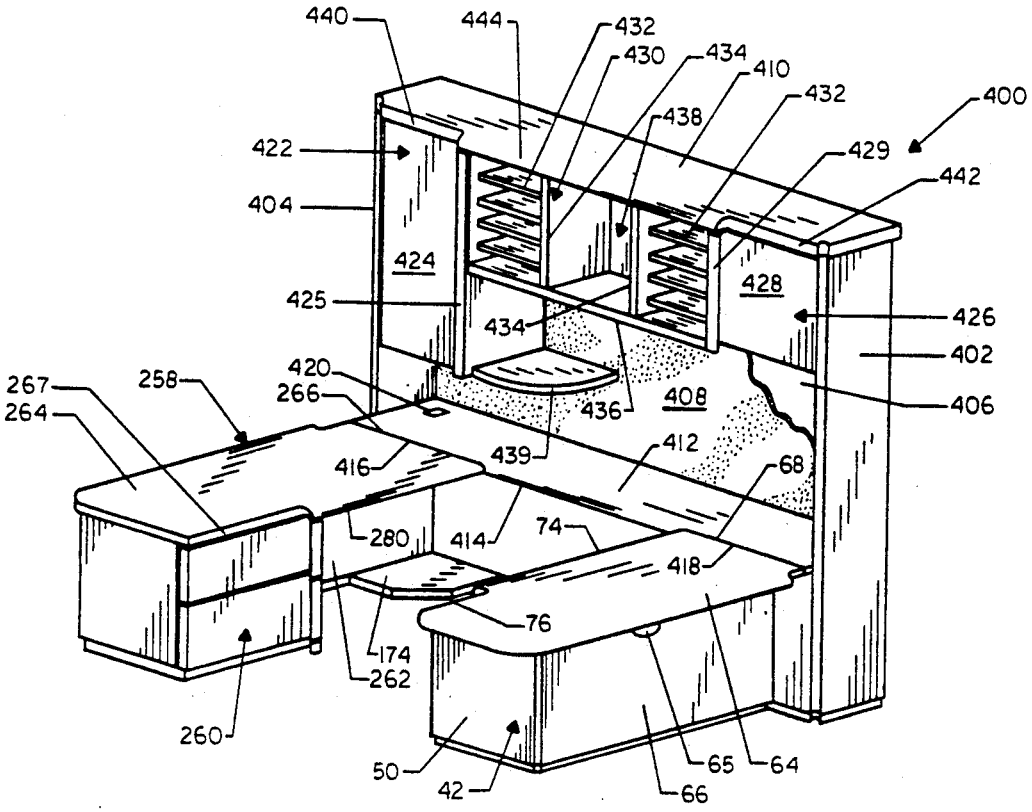
FIG. 34 is a perspective view of another embodiment of the invention.

Referring now to FIG. 34, there is shown yet another embodiment of the invention in which a desk, a return and a credenza are combined with an organizer having a storage column. The desk 42 is similar to the desk shown in FIGS. 1–3 in that it has a top 64 with a grommet 65, a front modesty skirt 66 and a pedestal 50. The pedestal is positioned on the right side of the desk from the orientation of the user in FIG. 34 whereas the pedestal is positioned on the left side of the desk as viewed from the user in FIGS. 1–4. However, the desk is otherwise the same.

A credenza 258 is similar to the credenza shown in FIG. 22 except that the credenza 258 shown in FIG. 34 is a mirror image of the credenza shown in FIG. 22.

An organizer 400 spans the desk 42 and the credenza 258. The organizer has a pair of vertical sidewalls 402 and 404, a back wall 406, a top panel 410 and a work surface 412, all joined together to form a rigid, free-standing unit. If desirable, the desk and credenza can be fixedly secured to the organizer at the interfacing edges thereof.

A tackboard 408 can be mounted to the front surface of the back wall 406 for tacking paperwork.

The work surface 412 has a front edge which has a rounded portion 414 and notched portions 416 and 418. A grommet 420 is mounted in the top panel 410 for passage of wiring between those portions above and below the work surface panel 412.

A storage cabinet 422 is mounted in an upper left corner of the organizer and includes a door 424 which is hinged to the cabinet at the left side thereof as viewed in FIG. 34. A handle 425 of a construction the same as handle 56 is provided at a right side of the door 424.

Similarly, a cabinet 426 is mounted at an upper right side of the organizer 410 and has a door 428 hinged to a right side of the cabinet to open away from the work area. Thus, the interior of the cabinets 422 and 426 are easily accessible from within the work area defined by the ensemble shown in FIG. 34. A handle 429 is mounted to the door 428 and is of a construction similar to the handle 128 illustrated in FIGS. 3, 5 and 6. Likewise, the handle 425 is of a construction similar to the handle 128 illustrated in FIGS. 3, 5 and 6.

The organizer cabinet 430 has two sets of open vertical shelves 432 supported by dividers 434 which are connected to a bottom shelf 436. Thus, an open storage area 438 is provided between the two sets of vertical shelves 432.

The top panel 410 has a front edge with notches 440 and 442 at the ends thereof in registry with the doors 424 and 428 of the cabinets 422 and 426, respectively. A rounded edge 444 of a configuration illustrated in FIG. 10 spans the front edge between the notches 440 and 442. The notches have a concave surface at the interface between the notches and the curved front edge 444 in similar construction as, for example, shown between the notch 76 and the curving edge 74 illustrated in FIGS. 2 and 4. The handles 425 and 429 have a cross sectional configuration which generally follows the configuration of the front edge of the overlying top panel 410. A shelf 439 can be mounted between the back wall 406 and the cabinet 422 in the open space beneath shelf 436.

If desired, the cabinets 422 and 426 and the organizer cabinet 430 with the top panel 410 can be constructed as a unit and mounted to a wall in overlying configuration to a desk, return and credenza configuration as illustrated, for example, in FIG. 18. In the event that the wall-mounted organizer is used the storage columns 220 and the organizer 230 can be eliminated from the credenza. In this case, the sidewalls 402 and 404 would be eliminated.

Figure 35:
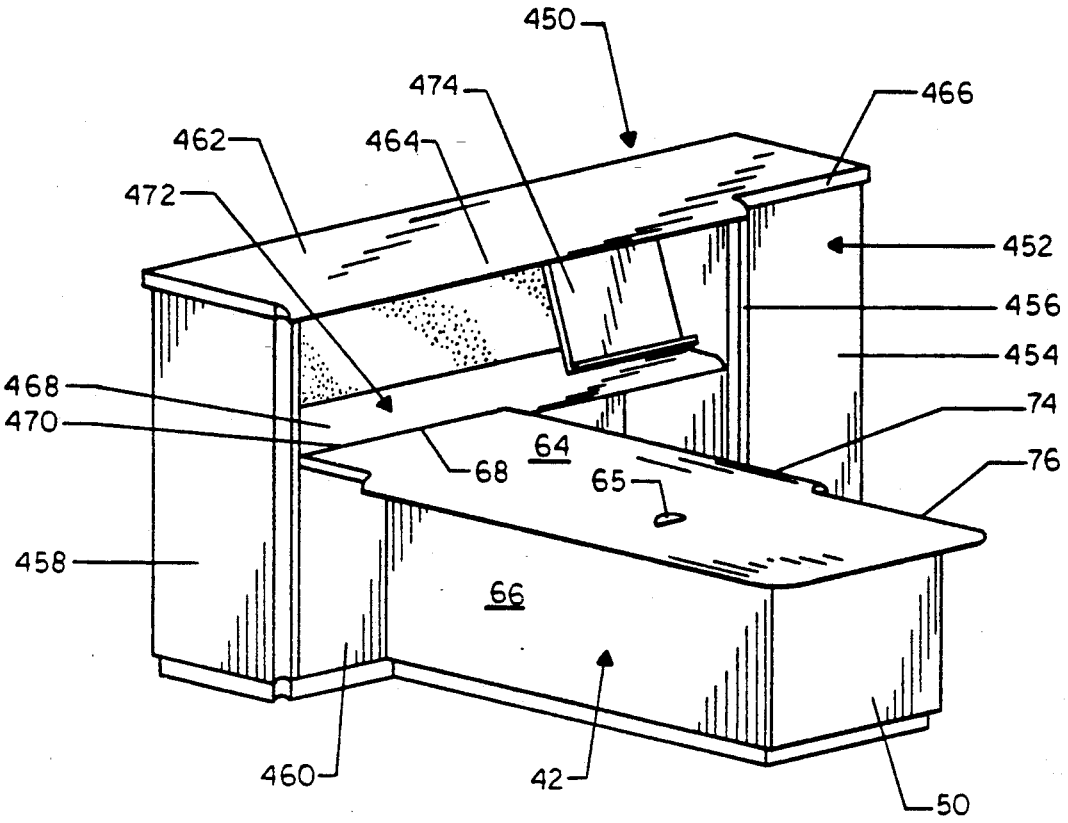
FIG. 35 is a perspective view of yet another furniture ensemble according to the invention.

Reference is now made to FIG. 35 which shows yet another embodiment of the invention. In FIG. 35 there is shown the combination of a desk and stand-up desk surface combined with an organizer and truncated column. The desk 42 is of the same construction as illustrated in FIGS. 1–4 and includes a desk top 64 having a grommet 65, a front modesty skirt 66 and a pedestal 50.

The organizer column assembly 450 comprises a cabinet 452 having a door 454 hinged at the right side thereof for opening away from the desk 42 and also having a handle 456 of the same configuration as the handle 128 shown on FIGS. 3 and 5. The organizer column 450 further has a sidewall 458 and a filler panel 460 joined together to form a left side of the unit. A top panel 462 is mounted on top of the sidewall 458 and the cabinet 452 in overlying relationship thereto and defining an organizer space therebeneath. The top panel 462 has a front edge which has a rounded portion 464 extending from one edge thereof to a notched portion 466 at another end thereof. The notched portion 466 is in register with the cabinet door 454. The handle 456 has a cross sectional configuration which generally follows the configuration of the front edge of the top surface between the notched portion 466 and the rounded edge portion 464.

A work surface 468 is mounted between the cabinet 452 and the sidewall 458. The work surface 468 has a notch 470 which interfaces with the right end 68 of the desk top 64 in a manner similar to the interface between the desk top 64 and the panel 94 of the organizer shown in FIGS. 1–4.

The open space between the top panel 462 and the work surface panel 468 near the sidewall 458 provides a niche 472 for positioning of a computer terminal.

A sliding easel 474 is positioned at the right end of the work surface 468 for use by user of the space.

The organizer column unit 450 is constructed so that the top panel 462 is approximately 45 inches high, or a suitable height for a stand-up work surface. A rounded surface 464 provides a suitable interface between the user and the top panel 462.

The several embodiments of the invention illustrate the numerous variations which can be devised by an end user to fit his or her particular work environment. There are key elements to the invention, such as the notches (76, 98), the rounded user interface edges (74, 96) and the interfitting relationship between components. All of these components can be made from stock materials which can be machined with numerically controlled equipment to fashion the desired work surface, credenza, return or organizer configuration without expensive special order manufacturing procedures. The pedestals can be standard sizes and used with various work surface panel or credenza panel configurations. Complete office configurations, fashioned for machine and/or paper intensive environments, can be selected to meet small, compact space or generous space availability. The invention provides in case goods furniture a rich mix of user driven options with cost effective manufacturing available heretofore only with systems furniture.

Although a number of preferred embodiments of individual furniture pieces and furniture ensembles have been specifically illustrated described herein, it is to be understood that other modifications may be made without departing from the spirit and scope of the invention as defined by the appended claims.

The embodiments of the invention for which an exclusive property or privilege is claimed are defined as follows:

1. An ensemble of separate office furniture components having:

first and second horizontally disposed work surface panels of separate components at work surface height above the floor, each of said work surface panels having front edges and end edges bounding three sides of the work surfaces and portions of the front edges of rounded configuration;

the work surface panels being positioned in perpendicular relationship to each other with a first edge of one work surface panel abutting a front edge of a second work surface panel;

the front edge of the second work surface panel having a notch in confronting relationship with the end edge of the first work surface panel;

the notch extending to a first end edge of the second work surface panel and having a concavely curved surface portion at a first end of the notch joining said notch with said rounded front edge portion of said second work surface panel;

the surface of the notch and the end edge of the first work surface having complementary surfaces in abutting relationship with each other;

whereby the first and second work surfaces have rounded front edges converging in a flush jointed corner.

2. A furniture ensemble according to claim 1 wherein the notch and the first end edge of the first work surface are substantially vertical in orientation, normal to the first and second work surface panels.

3. A furniture ensemble according to claim 1 wherein the radius of curvatures of the front edge portion of the first and second work surface panels are substantially equal.

4. A furniture ensemble according to claim 3 wherein the notch has a depth substantially equal to the radius of curvature of the front edge portion of the second work surface panel.

5. A furniture ensemble according to claim 1 wherein the first work surface front edge has a notch at an end portion distal from the first end edge.

6. A furniture ensemble according to claim 1 wherein the notch and first end edge of the first work surface are substantially vertical in orientation, normal to the first and second work surface panels.

7. A furniture ensemble according to claim 1 wherein the second work surface panel has a forwardly directed portion of the front edge forming a diagonal corner adjacent the first end edge for supporting a keyboard.

8. A furniture ensemble comprising first and second articles of office furniture abutted together in end-to-edge relation, said first article of furniture comprising a flat panel member having an edge, said edge having one end and an elongated notch starting at said one end, said notch having first and second ends, said notch forming a notch opening at said one end of the edge, and the second end of said notch being defined by a concavely curved edge portion, said notch also including an edge extending between said first end and said concavely curved edge portion, and said second article of furniture having an end edge seated in said notch.

9. A furniture ensemble according to claim 8 wherein said notch edge and concavely said curved edge portion are generally disposed normal to said flat panel.

10. A furniture ensemble according to claim 8 wherein sa end edge terminates in a rounded convexly curved corner matching said concavely curved edge portion.

11. A furniture ensemble according to claim 10 wherein said second article of furniture includes a second flat panel, and said end edge and said rounded convexly curved corner are generally disposed normal to said flat panel.

12. A furniture ensemble according to claim 8 together with a third article of office furniture having an edge facing said first article of furniture edge, said third article of furniture edge having a notch therein aligned with said first article of furniture notch, and said second article of furniture having an opposite end edge seated in said third article of furniture notch.

13. A furniture ensemble according to claim 8 wherein said second article of furniture has a rounded front edge adjacent to said end edge to form a user edge interface for said second article of furniture.

14. A furniture ensemble according to claim 12 wherein said first article of furniture is a desk, said second article of furniture is a return, and said third article of furniture is a credenza.

* * * * *

UNITED STATES PATENT AND TRADEMARK OFFICE

CERTIFICATE OF CORRECTION

PATENT NO. : 5,255,966

DATED : October 26, 1993

INVENTOR(S) : NEWHOUSE et al.

It is certified that error appears in the above-identified patent and that said Letters Patent is hereby corrected as shown below:

Column 19, claim 1, line 9:
"first edge" should read --first end edge--

Column 20, claim 9, line 19:
"concavely said" should read --said concavely--

Column 20, claim 10, line 21:
"sa end" should read --said end--

Signed and Sealed this

Twenty-sixth Day of April, 1994

*Attest:*

Bruce Lehman

BRUCE LEHMAN

*Attesting Officer*

*Commissioner of Patents and Trademarks*